US010191408B2

(12) United States Patent
Kyotani et al.

(10) Patent No.: US 10,191,408 B2
(45) Date of Patent: Jan. 29, 2019

(54) IMAGE FORMING APPARATUS AND CARTRIDGE INCLUDING DETECTION GEAR

(71) Applicant: BROTHER KOGYO KABUSHIKI KAISHA, Nagoya-shi, Aichi-ken (JP)

(72) Inventors: Tadao Kyotani, Nagoya (JP); Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/404,680

(22) Filed: Jan. 12, 2017

(65) Prior Publication Data

US 2017/0261883 A1 Sep. 14, 2017

(30) Foreign Application Priority Data

Mar. 11, 2016 (JP) ..... 2016-047810

(51) Int. Cl.
*G03G 15/00* (2006.01)
*G03G 15/08* (2006.01)
*G03G 21/18* (2006.01)

(52) U.S. Cl.
CPC ..... *G03G 15/0863* (2013.01); *G03G 15/0856* (2013.01); *G03G 21/1889* (2013.01); *G03G 21/1896* (2013.01)

(58) Field of Classification Search
CPC ..... G03G 15/0863; G03G 15/0831
See application file for complete search history.

(56) References Cited

U.S. PATENT DOCUMENTS 6,587,649 B1 7/2003 Yamamoto et al.
7,623,255 B2 11/2009 Simpson
2004/0042804 A1 3/2004 Yamamoto et al.
(Continued)

FOREIGN PATENT DOCUMENTS

JP 2001-117440 A 4/2001
JP 2006-201430 A 8/2006
(Continued)

OTHER PUBLICATIONS

English translation of International Search Report and Written Opinion previously submitted, from corresponding International Patent Application No. PCT/JP2016/089048 dated Mar. 7, 2017.
(Continued)

*Primary Examiner* — Walter L Lindsay, Jr.
*Assistant Examiner* — Jessica L Eley
(74) *Attorney, Agent, or Firm* — Merchant & Gould P.C.

(57) ABSTRACT

A cartridge configured to accommodate a developing agent may include a detection gear, a first protrusion, and a memory. The detection gear may be rotatable about a first axis extending in a predetermined direction. The first protrusion may be movable with rotation of the detection gear. The memory may include a first storage region storing a first yield information representing at least one of amount of the developing agent in the cartridge and the number of printable sheets by the developing agent in the cartridge, wherein at least one of the amount of the developing agent and the number of sheets by the developing agent in the cartridge may be confirmable based on the first yield information and the first protrusion.

25 Claims, 25 Drawing Sheets

(56) References Cited

U.S. PATENT DOCUMENTS

| | | | | |
|---|---|---|---|---|
| 2006/0193646 | A1* | 8/2006 | Suzuki | G03G 21/1896 399/12 |
| 2006/0216046 | A1 | 9/2006 | Hatakeyama | |
| 2007/0122165 | A1 | 5/2007 | Igarashi et al. | |
| 2015/0063833 | A1 | 3/2015 | Shinagawa | |
| 2015/0192880 | A1 | 7/2015 | Noda et al. | |
| 2017/0261884 | A1 | 9/2017 | Kyotani | |

FOREIGN PATENT DOCUMENTS

| | | | |
|---|---|---|---|
| JP | 2007-072123 | A | 3/2007 |
| JP | 2007-148285 | A | 6/2007 |
| JP | 2008-242085 | A | 10/2008 |
| JP | 2015-099219 | A | 5/2015 |
| JP | 2015-129815 | A | 7/2015 |
| JP | 2015-180545 | A | 10/2015 |

OTHER PUBLICATIONS

Related U.S. Appl. No. 15/431,412, filed Feb. 13, 2017.

International Search Report and Written Opinion from corresponding International Patent Application No. PCT/JP2016/089048, dated Mar. 7, 2017.

International Search Report and Written Opinion from corresponding International Patent Application No. PCT/JP2017/005104 dated Apr. 4, 2017.

English translation of International Search Report and Written Opinion from corresponding International Patent Application No. PCT/JP2017/005104 dated Apr. 4, 2017.

Office Action issued in related U.S. Appl. No. 15/431,412, dated Aug. 31, 2017.

Office Action (Notice of Allowance) issued in related U.S. Appl. No. 15/431,412, dated Jun. 18, 2018.

* cited by examiner

IMAGE FORMING APPARATUS AND CARTRIDGE INCLUDING DETECTION GEAR

CROSS REFERENCE TO RELATED APPLICATION

This application claims priority from Japanese Patent Application No. 2016-047810 filed Mar. 11, 2016. The entire content of the priority application is incorporated herein by reference.

TECHNICAL FIELD

The present disclosure relates to a cartridge for use in an image forming apparatus, and also relates to an image forming apparatus provided with the cartridge.

BACKGROUND

An electro-photographic type image forming apparatus such as a laser printer and an LED printer is known in the prior art. A cartridge is attachable to and detachable from the image forming apparatus. The cartridge is configured to accommodate therein toner.

The number of printable sheets printed by the cartridge is defined as yield information. The image forming apparatus monitors service life of the cartridge on the basis of the yield information. Such image forming apparatus and cartridge are described in the prior art. Further, a cartridge including a detection gear is known in the art. Upon attachment of the cartridge to the image forming apparatus, the detection gear can rotate and a sensor in the image forming apparatus can detect the detection gear as a signal. The image forming apparatus performs determination process as to whether the cartridge is a new cartridge and/or the image forming apparatus obtains yield information on the basis of the signal obtained from the sensor.

SUMMARY

However, if the determination is dependent on the yield information obtained from the detection gear, the yield information may be erroneously recognized under particular states such as forcible change in position of the detection gear. In this case, monitoring to the service life of the cartridge may be performed on the basis of the erroneous yield information.

It is therefore an object of the disclosure to provide a cartridge and an image forming apparatus capable of suitably monitoring the service life of the cartridge. According to one aspect, the disclosure provides a cartridge configured to accommodate a developing agent. The cartridge may include a detection gear, a first protrusion, and a memory. The detection gear may be rotatable about a first axis extending in a predetermined direction. The first protrusion may be movable with rotation of the detection gear. The memory may include a first storage region storing a first yield information representing at least one of amount of the developing agent in the cartridge and the number of printable sheets by the developing agent in the cartridge, wherein at least one of the amount of the developing agent and the number of printable sheets by the developing agent in the cartridge may be confirmable based on the first yield information and the first protrusion.

According to another aspect, the disclosure provides an image forming apparatus including a cartridge, a frame, a sensor, and a controller. The cartridge may be configured to accommodate a developing agent. The cartridge may include a detection gear rotatable about a first axis extending in a predetermined direction; a first protrusion movable with rotation of the detection gear; and a first memory including a first storage region storing a first yield information representing at least one of amount of the developing agent in the cartridge and the number of printable sheets by the developing agent in the cartridge. The frame may be configured to hold the cartridge. The sensor may be configured to detect movement of the first protrusion to generate second yield information. The controller may be configured to confirm one of the amount of the developing agent in the cartridge and the number of printable sheets by the developing agent based on the first yield information and the second yield information.

BRIEF DESCRIPTION OF THE DRAWINGS

The particular features and advantages of the disclosure will become apparent from the following description taken in connection with the accompanying drawings, in which.

DETAILED DESCRIPTION

An image forming apparatus according to a first embodiment will be described while referring to the accompanying drawings.

1. Structure of Image Forming Apparatus

Figure 1:
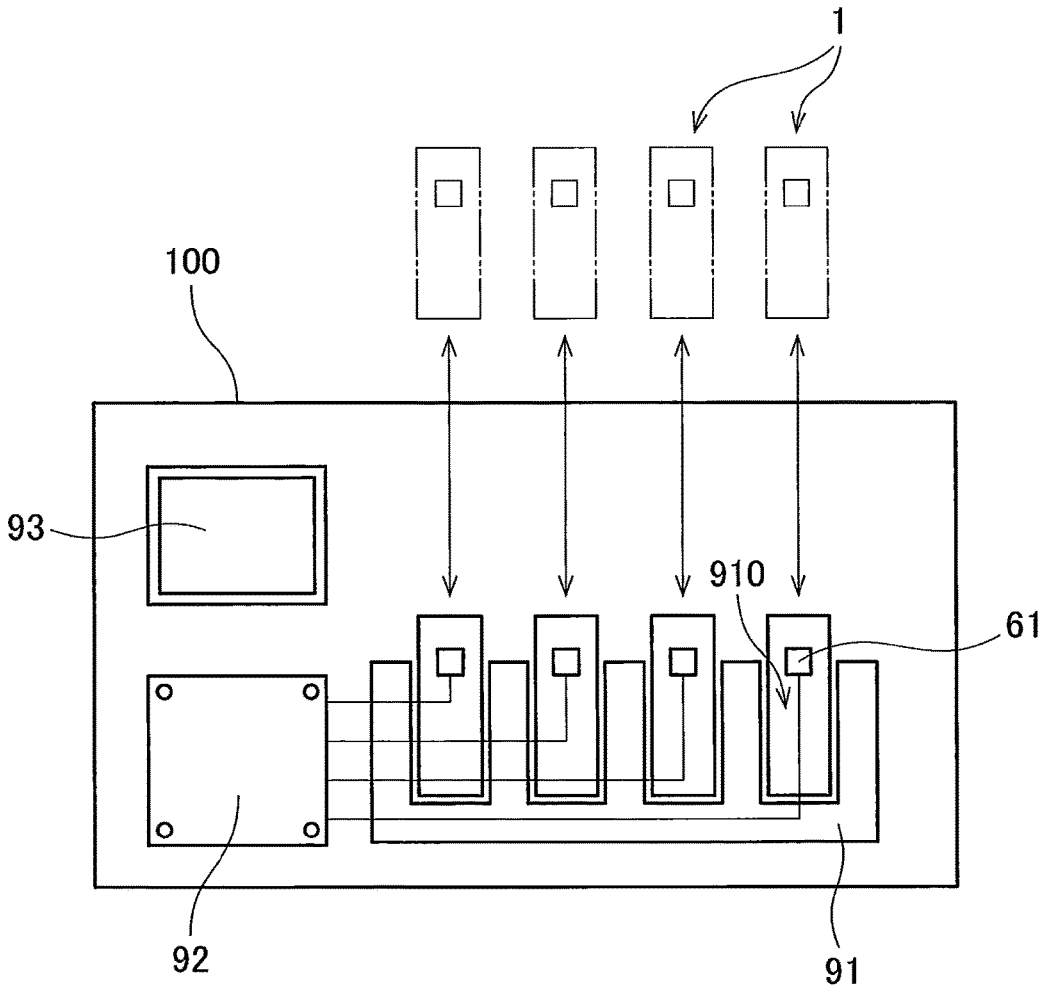
FIG. 1 is a conceptual diagram illustrating an image forming apparatus according to one embodiment.

An image forming apparatus 100 is illustrated in FIG. 1. The apparatus is an electro-photographic type printer, such as a laser printer and an LED printer. The image forming apparatus 100 includes four developing cartridges 1, a drawer unit 91, a controller 92, and a display 93. The drawer unit 91 is an example of a frame in which the four developing cartridges 1 can be held. The image forming apparatus 100 is configured to form an image on a sheet with developing agent such as toner supplied from each of the developing cartridges 1.

Figure 2:
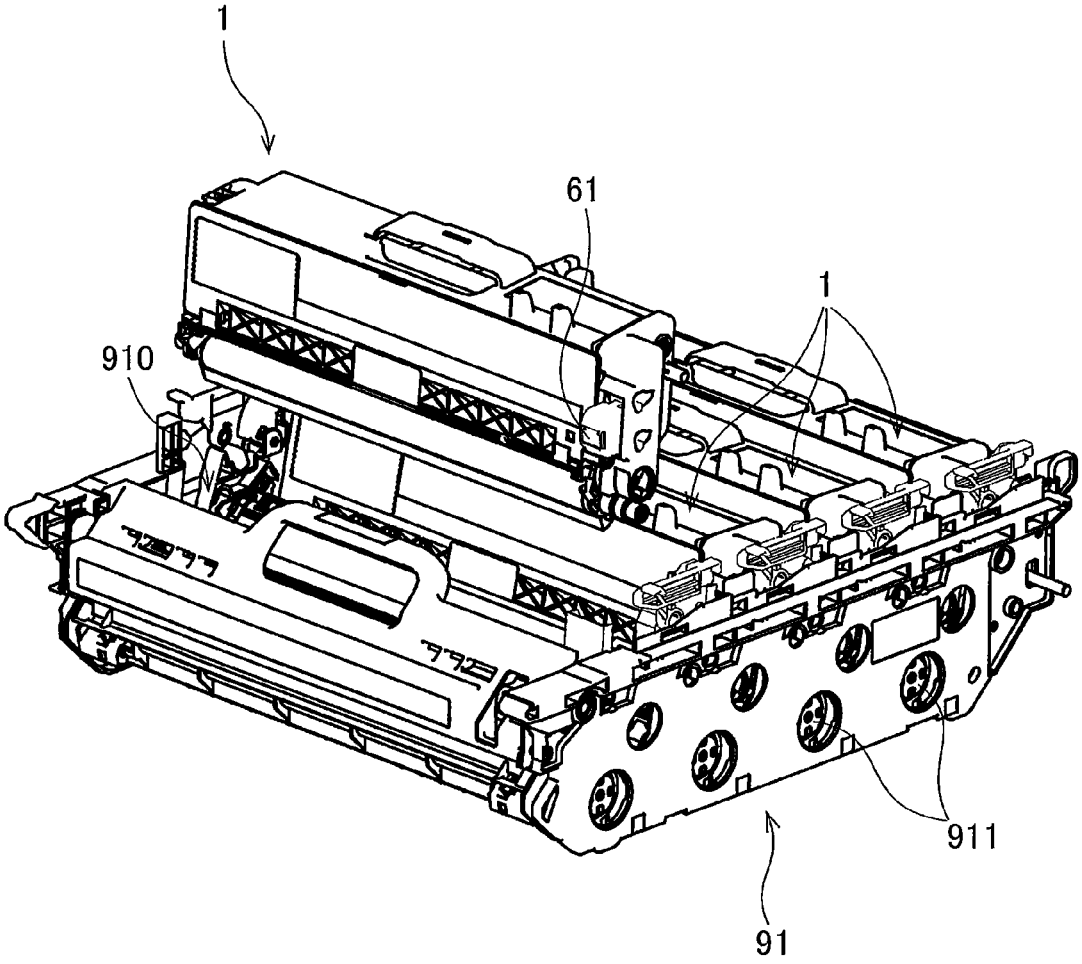
FIG. 2 is a perspective view of a drawer unit and a developing cartridge according to the embodiment.
Figure 3:
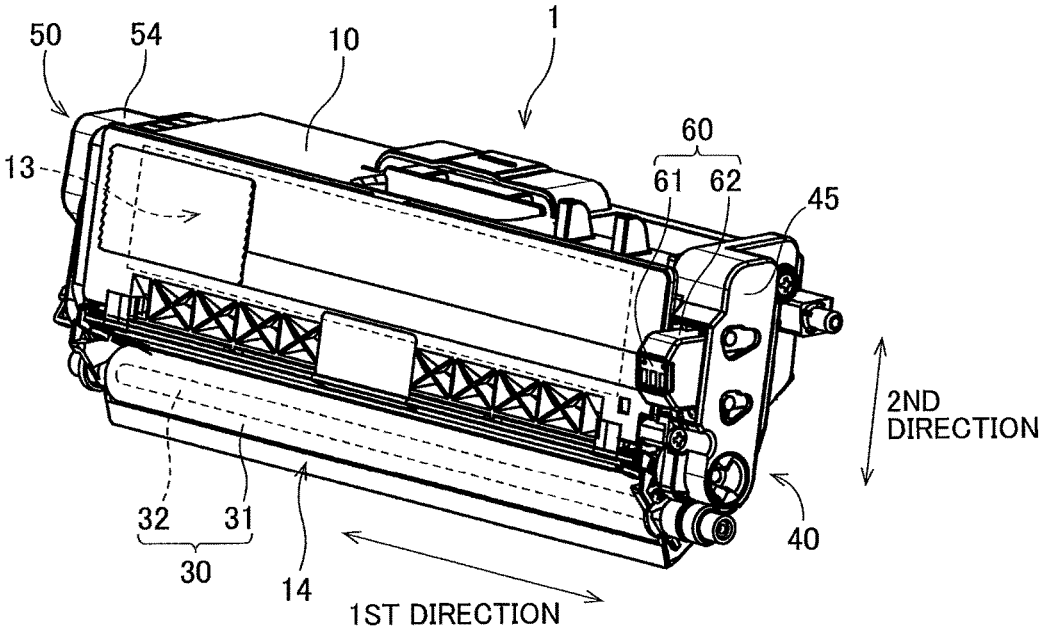
FIG. 3 is a perspective view of the developing cartridge according to the embodiment.
Figure 4:
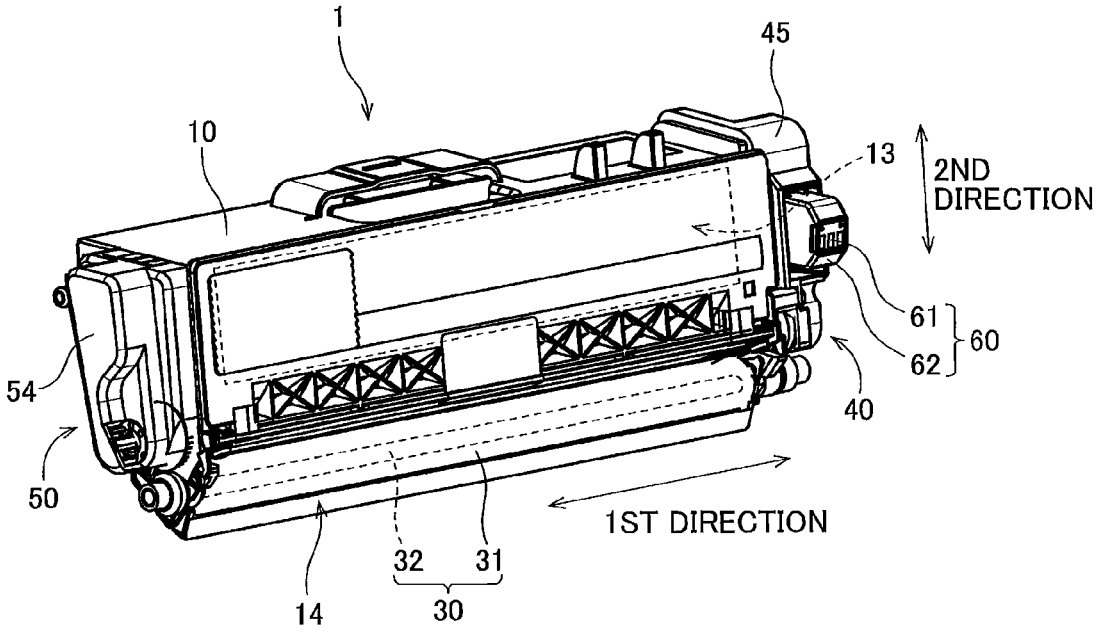
FIG. 4 is another perspective view of the developing cartridge according to the embodiment.

The drawer unit 91 and the developing cartridge 1 are illustrated in FIG. 2. Each of the four developing cartridges 4 can be replaced by a new cartridge in the drawer unit 91. To replace the developing cartridge 1 by a new cartridge, the drawer unit 91 is pulled out from a front side of the image forming apparatus 100. The drawer unit 91 includes a plurality of slots 910 that the developing cartridges 1 are detached from and attached into. A photosensitive drum 911 is provided at a position adjacent to the bottom portion of each slot 910.

In the embodiment, the four developing cartridges 1 are attached to the drawer unit 91. The four developing cartridges 1 accommodate therein developing agents of different colors such as cyan, magenta, yellow, and black, respectively. The number of the developing cartridges 1 to be attached to the drawer unit 91 is not limited to four, but from one to three cartridges or not less than five cartridges may be attached to the drawer unit 91. As illustrated in FIG. 1, each developing cartridge 1 includes a cartridge IC 61. The cartridge IC 61 is, for example, an IC chip being capable of reading and writing information.

The controller 92 includes a processor 921 (FIG. 13) such as a CPU, and one or more of memories. The controller 92 includes, for example, a circuit board. The controller 92 is configured to execute various processes in the image forming apparatus 100 by the operation of the processor 921 in accordance with one or more of programs store in the one or more of memories. By the attachment of the four developing cartridges 1 to the drawer unit 91, the cartridge IC 61 of each developing cartridge 1 is electrically connected to the controller 92. The display 93 is configured to display on a display screen various information relating to the operation of the image forming apparatus 100.

2. Structure of Developing Cartridge

As illustrated in FIGS. 3 through 6, the developing cartridge 1 includes a casing 10, agitator 20, developing roller 30, a first gear portion 40, a second gear portion 50 and a IC chip assembly 60.

Figure 5:
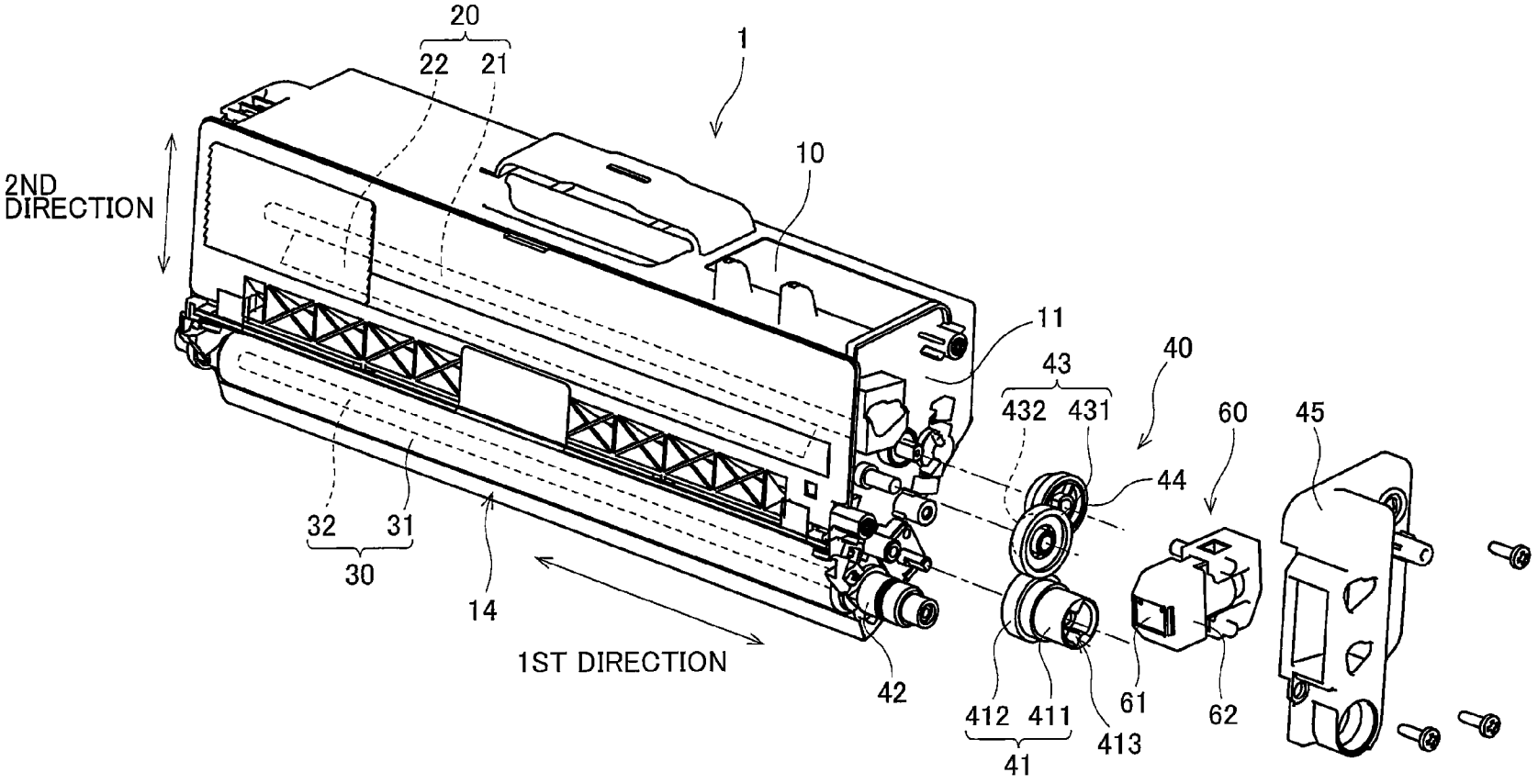
FIG. 5 is an exploded perspective view of the developing cartridge according to the embodiment.
Figure 6:
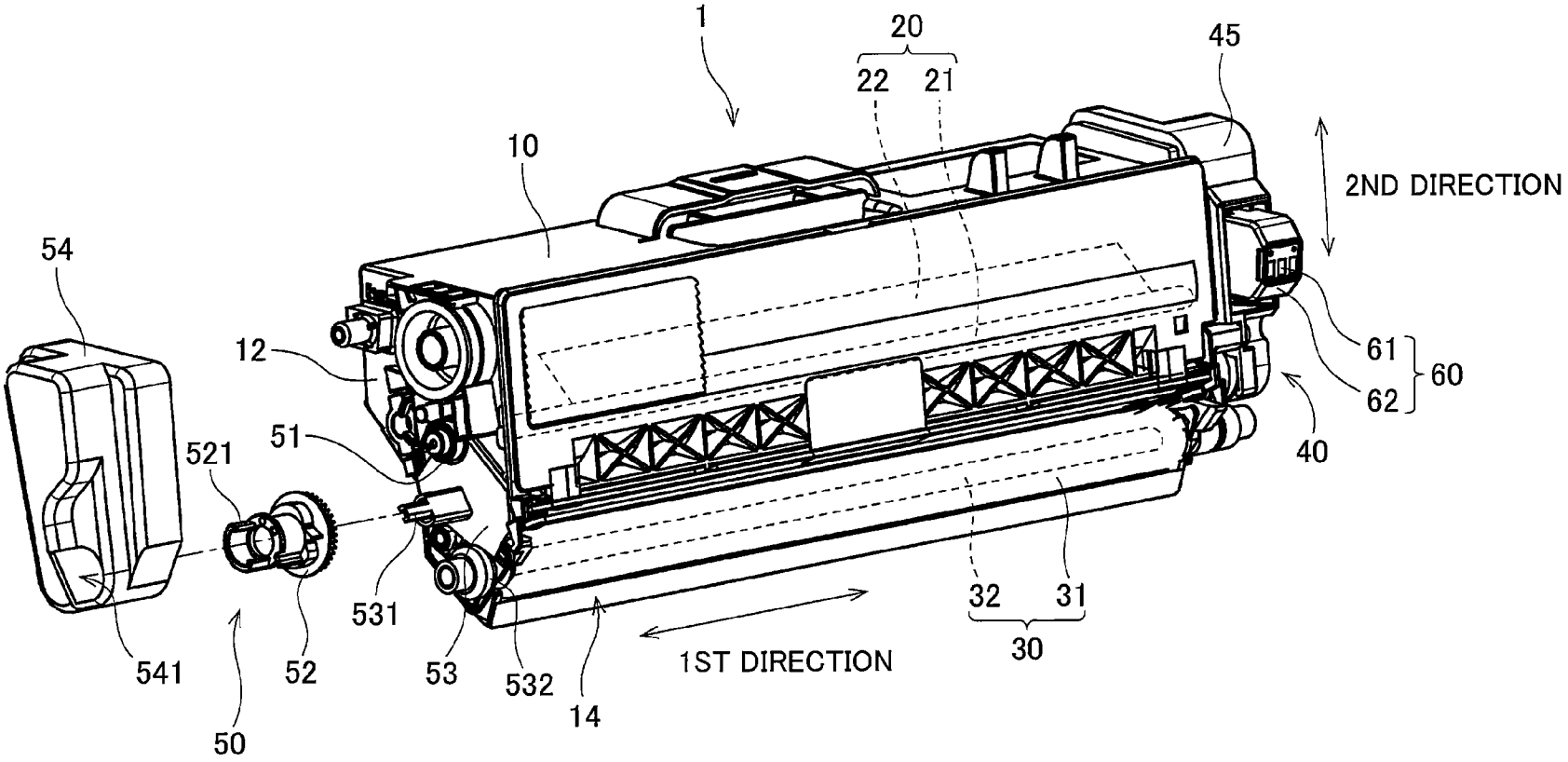
FIG. 6 is another exploded perspective view of the developing cartridge according to the embodiment.

The casing 10 is configured to accommodate therein developing agent. The casing 10 extends in a first direction between a first end face 11 (FIG. 5) and a second end face 12 (FIG. 6). The first gear portion 40 and the IC chip assembly 60 are positioned at the first end face 11, while the second gear portion 50 is positioned at the second end face 12. An accommodation chamber 13 is disposed in the casing 10 so as to accommodate a developing agent. The casing 10 has an opening 14 positioned at an end portion of the casing 10 in a second direction perpendicular to the first direction. The outside and inside of the accommodation chamber 13 are communicated with each other through the opening 14.

The agitator 20 includes an agitator shaft 21 and a blade 22. The agitator shaft 21 extends in the first direction, and the blade 22 extends radially outwardly from the agitator shaft 21. The blade 22 and at least portion of the agitator shaft 21 are positioned in the accommodation chamber 13. The agitator shaft 21 has one portion and another end portion in the first direction, and a first agitator gear 44 (described later) is mounted to the one end portion and a second agitator gear 51 (described later) is mounted to the other end portion, so that the agitator shaft 21 and the blade 22 are rotatable along with the rotation of the first agitator gear 44 and the second agitator gear 51. By the rotation of the blade 22, the developing agent in the accommodation chamber 13 is agitated.

The developing roller 30 is rotatable about a rotation axis (second axis) extending in the first direction, and is positioned at the opening portion 14 of the casing 10. The developing roller 30 includes a developing roller body 31 and the developing roller shaft 32. The developing roller body 31 is a hollow cylindrical member extending in the first direction and is made from an elastic material such as rubber. The developing roller shaft 32 is a rigid cylindrical member extending through the developing roller body 31 in the first direction. The developing roller shaft 32 is made from metal or electrically conductive resin. The developing roller body 31 is fixed to the developing roller shaft 32 so that relative rotation therebetween does not occur.

The developing roller shaft 32 has an one end portion in the first direction mounted to a developing roller gear 42 (described later) so that relative rotation between the developing roller shaft 32 and the developing roller gear 42 is prevented. Therefore, by the rotation of the developing roller gear 42, the developing roller shaft 32 is rotated, and the developing roller body 31 is also rotated along with the developing roller shaft 32.

Incidentally, the developing roller shaft 32 is not necessarily extends through the length of the developing roller body 31 in the first direction. Instead, a first developing roller shaft can extend from one end of the developing roller body 31, and a second developing roller shaft can extend from the other end of the developing roller body 31.

The developing cartridge 1 includes a supply roller (not shown). The supply roller is positioned between the developing roller 30 and the accommodation chamber 13, and is rotatable about a rotation axis (fourth axis) extending in the first direction. Upon receipt of driving force in the developing cartridge 1, the developing agent in the accommodation chamber 13 of the casing 10 is supplied to an outer peripheral surface of the developing roller 30 through the supply roller. In this case, the developing agent is triboelectrically charged between the developing roller 30 and the supply roller. On the other hand, bias voltage is applied to the developing roller shaft 32 of the developing roller 30. Accordingly, the developing agent is attracted to the outer peripheral surface of the developing roller body 31 by the electrostatic force between the developing roller shaft 32 and the developing agent.

The developing cartridge 1 also includes a toner layer thickness regulation blade (not shown). The blade is configured to form a developing agent layer formed on the outer surface of the developing roller body 31 into a uniform thickness. Then, the developing agent carried on the outer peripheral surface of the developing roller body 31 is supplied to the photosensitive drum 911 provided at the drawer unit 91. In this instance, developing agent is transferred from the developing roller body 31 to the photosensitive drum 911 so as to form a toner image corresponding to an electrostatic latent image formed on the photosensitive drum 911. Thus, a visible toner image is formed on the outer surface of the photosensitive drum 911.

The first gear portion 40 is positioned at the first end face 11 of the casing 10. As illustrated in FIG. 5, the first gear portion 40 includes a coupling 41, the developing roller gear 42, an idle gear 43, the first agitator gear 44 and a first cover 45. Incidentally, gear teeth of each of the gears are omitted in FIG. 5.

The coupling 41 is configured to receive driving force supplied from the image forming apparatus 100. The coupling 41 is rotatable about a rotation axis (third axis) extending in the first direction. The coupling 41 includes a coupling portion 411 and a coupling gear 412, these being made integrally from resin. The coupling portion 411 has an engagement hole 413 recessed in the first direction. A plurality of gear teeth are provided at an equal interval between neighboring teeth at an outer peripheral portion of the coupling gear 412.

When the drawer unit 91 to which the developing cartridge 1 is attached is mounted in the image forming apparatus 100, a drive shaft (not shown) of the image forming apparatus 100 is inserted into the engagement hole 413 of the coupling portion 411. Thus, the drive shaft and the coupling portion 411 are coupled, so that the rotation relative to each other is prevented. Accordingly, by the rotation of the drive shaft, the coupling portion 411 is rotated so that the coupling gear 412 is rotated along with the rotation of the coupling portion 411.

The developing roller gear 42 is configured to rotate the developing roller 30, and is rotatable about a rotation axis extending in the first direction. The developing roller gear 42 has an outer peripheral surface at which a plurality of gear teeth are provided along entire peripheral length thereof at equal interval between neighboring gears. The coupling gear 412 is in meshing engagement with the developing roller gear 42. The developing roller gear 42 is mounted to one end portion of the developing roller shaft 32 of the developing roller 30 in the first direction so as to avoid relative rotation between the developing roller gear 42 and the developing roller shaft 32. Accordingly, by the rotation of the coupling gear 412, the developing roller gear 42 is rotated, and the developing roller 30 is rotated along with the rotation of the developing roller gear 42.

The idle gear 43 is configured to transmit rotation of the coupling gear 412 to the first agitator gear 44, and is rotatable about a rotation axis extending in the first direction. The idle gear 43 includes a large diameter gear portion 431 and a small diameter gear portion 432 arrayed side by side in the first direction. The small diameter gear portion 432 is positioned between the large diameter gear portion 431 and the first end face 11 of the casing 10. In other words, the large diameter gear portion 431 is positioned farther from the first end face 11 than the small diameter gear portion 432 is from the first end face 11. The small diameter gear portion 432 has an addendum circle having a diameter smaller than the diameter of the addendum circle of the large diameter gear portion 431. The large diameter gear portion 431 and the small diameter gear portion 432 are integrally made from resin.

A plurality of gear teeth are provided at an outer peripheral portion of the large diameter gear portion 431 along the entire peripheral length of the large diameter gear portion 431. A plurality of gear teeth are provided at an outer peripheral portion of the small diameter gear portion 432 along an entire peripheral length of the small diameter gear portion 432. The number of gear teeth of the small diameter gear portion 432 is smaller than the number of gear teeth of the large diameter gear portion 431. The large diameter gear portion 431 is in meshing engagement with the coupling gear 412, and the small diameter gear portion 432 is in meshing engagement with the first agitator gear 44. By the rotation of the coupling gear 412, the large diameter gear portion 431 is rotated, and the small diameter gear portion 432 is rotated along with the rotation of the large diameter gear portion 431, thereby rotating the first agitator gear 44.

The first agitator gear 44 is configured to rotate the agitator 20 positioned in the accommodation chamber 13, and is rotatable about a rotation axis extending in the first direction. A plurality of gear teeth are provided at an entire outer peripheral surface of the first agitator gear 44 at an equal interval between neighboring gear teeth. As described above, the small diameter gear portion 432 is in meshing engagement with the first agitator gear 44. Further, the first agitator gear 44 is mounted to one end portion of the agitator shaft 21 in the first direction avoiding relative rotation therebetween. Accordingly, by the power transmission to the first agitator gear 44 from the coupling 41 through the idle gear 43, the first agitator gear 44 is rotated, and the agitator 20 is rotated along with the rotation of the first agitator gear 44.

The first cover 45 is fixed to the first end face 11 of the casing 10 by, for example, screws. The first cover 45 and the first end face 11 constitute an accommodation space in which the coupling gear 412, the developing roller gear 42, the idle gear 43, and the first agitator gear 44 are accommodated. The engagement hole 413 of the coupling portion 411 is exposed to an outside of the first cover 45. The first cover 45 also functions as a holder cover for holding a holder 62 (described later) of the IC chip assembly 60.

The second gear portion 50 is positioned at the second end face 12 of the casing 10. As illustrated in FIG. 6, the second gear portion 50 includes the second agitator gear 51, a detection gear 52, an electrically conductive member 53, and a second cover 54. Incidentally, gear teeth of the second agitator gear 51 are omitted in FIG. 6.

The second agitator gear 51 is configured to transmit the rotation of the agitator shaft 21 to the detection gear 52. The second agitator gear 51 is rotatable about a rotation axis extending in the first direction. The second agitator gear 51 has an outer peripheral surface at which a plurality of gear teeth are provided along entire peripheral length of the plurality of gear teeth at equal interval between neighboring teeth. The second agitator gear 51 can be meshingly engaged with the detection gear 52 if the attached developing cartridge 1 is a new or unused cartridge. The second agitator gear 51 is mounted to another end portion of the agitator shaft 21 in the first direction while the relative rotation therebetween is prevented. Therefore, the second agitator gear 51 can be rotated by the rotation of the agitator shaft 21.

The detection gear 52 is configured to transmit information related to the developing cartridge 1 to the image forming apparatus 100. The information represents for example, whether the developing cartridge 1 is a new cartridge or a used cartridge. The information may represent specification of the developing cartridge 1 such as yield information including the amount of developing agent accommodated in the developing cartridge 1 or the number of printable sheets of the developing cartridge 1

The detection gear 52 is rotatable about a rotation axis (first axis) extending in the first direction. The detection gear 52 includes a plurality of gear teeth which are provided at a portion of an outer peripheral surface of the detection gear 52. In other words, the detection gear 52 includes a plurality of gear teeth a toothless portion which are provided at the outer peripheral surface of the detection gear 52.

When the drawer unit 91 to which a new developing cartridge 1 is attached is accommodated in the image forming apparatus 100, the coupling 41 receives driving force from the image forming apparatus 100. Thus, the second agitator gear 51 is rotated by the driving force transmitted from the coupling 41 through the idle gear 43, first agitator gear 44 and the agitator 20. The detection gear 52 is rotated by the meshing engagement with the gear teeth portion. However, when the detection gear 52 is rotated by a predetermined angle, the second agitator gear 51 is faced with the toothless portion so that the detection gear 52 is disengaged from the second agitator gear 51, thereby stopping rotation of the detection gear 52.

In this way, the second agitator gear 51 and the detection gear 52 are disengaged from each other in a case where the developing cartridge 1 has been used. Therefore, if such a used cartridge 1 is detached from the image forming apparatus 100 and is then attached thereto, rotation of the second agitator gear 51 is not transmitted to the detection gear 52, so that the detection gear 52 does not rotate.

Incidentally, another gear may be disposed between the second agitator gear 51 and the detection gear 52. For example, the second gear portion 50 may include a second idle gear in meshing engagement with the second agitator gear 51 and the detection gear 52. In the latter case, the rotation of the second agitator gear 51 may be transmitted to the detection gear 52 through the second idle gear.

Figure 7:
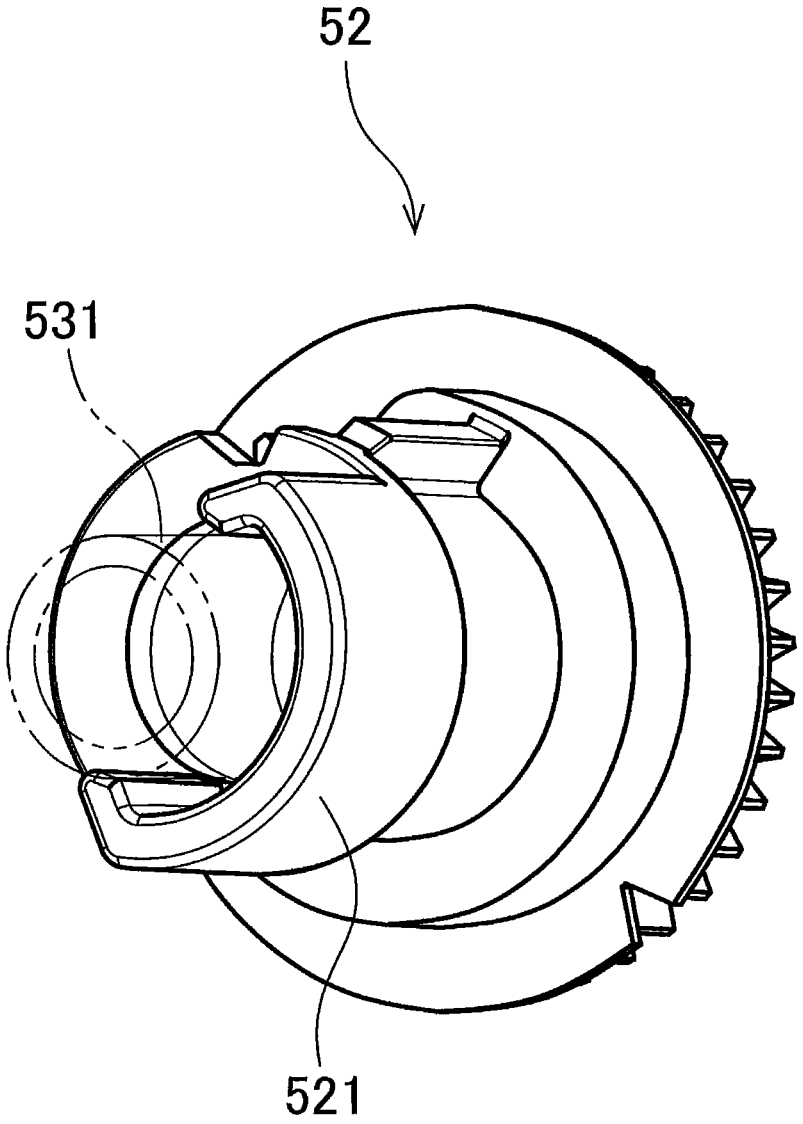
FIG. 7 is a perspective view of a detection gear of the developing cartridge according to the embodiment.

As illustrated in FIGS. 6 and 7, the detection gear 52 includes a first protrusion 521 protruding in the first direction. The first protrusion 521 has an arcuate shape extending with respect to the rotation axis of the detection gear 52. Upon rotation of the detection gear 52, the first protrusion 521 is movable about the rotation axis. That is, the angular position of the first protrusion 521 is changed in accordance with the rotation angle of the detection gear 52.

The electrically conductive member 53 is made from an electrically conductive material such as electrically conductive metal and electrically conductive resin. The electrically conductive member 53 is positioned at the second end face 12 of the casing 10. The electrically conductive member 53 includes a gear shaft 531 that has a hollow cylindrical shape extending in the first direction. The detection gear 52 is supported to the gear shaft 531 and is rotatable about the gear shaft 531. As illustrated in FIG. 7, the first protrusion 521 partly covers the peripheral portion of the gear shaft 531. Further, the electrically conductive member 53 includes a bearing portion 532 which is in contact with the developing roller shaft 32 of the developing roller 30.

The second cover 54 is attached to the second end face 12 of the casing 10 by screws, and the second cover 54 and the second end face 12 constitute an accommodation space in which the second agitator gear 51, the detection gear 52 and the electrically conductive member 53 are accommodated. The second cover 54 has an opening 541. A portion of the first protrusion 521 and a portion of the gear shaft 531 are exposed outside of the second cover 54 through the opening 541. A lever 912 (described later) is in contact with one of the detection gear 52 and the gear shaft 531 through the opening 541.

3. Detection Mechanism

Figure 8:
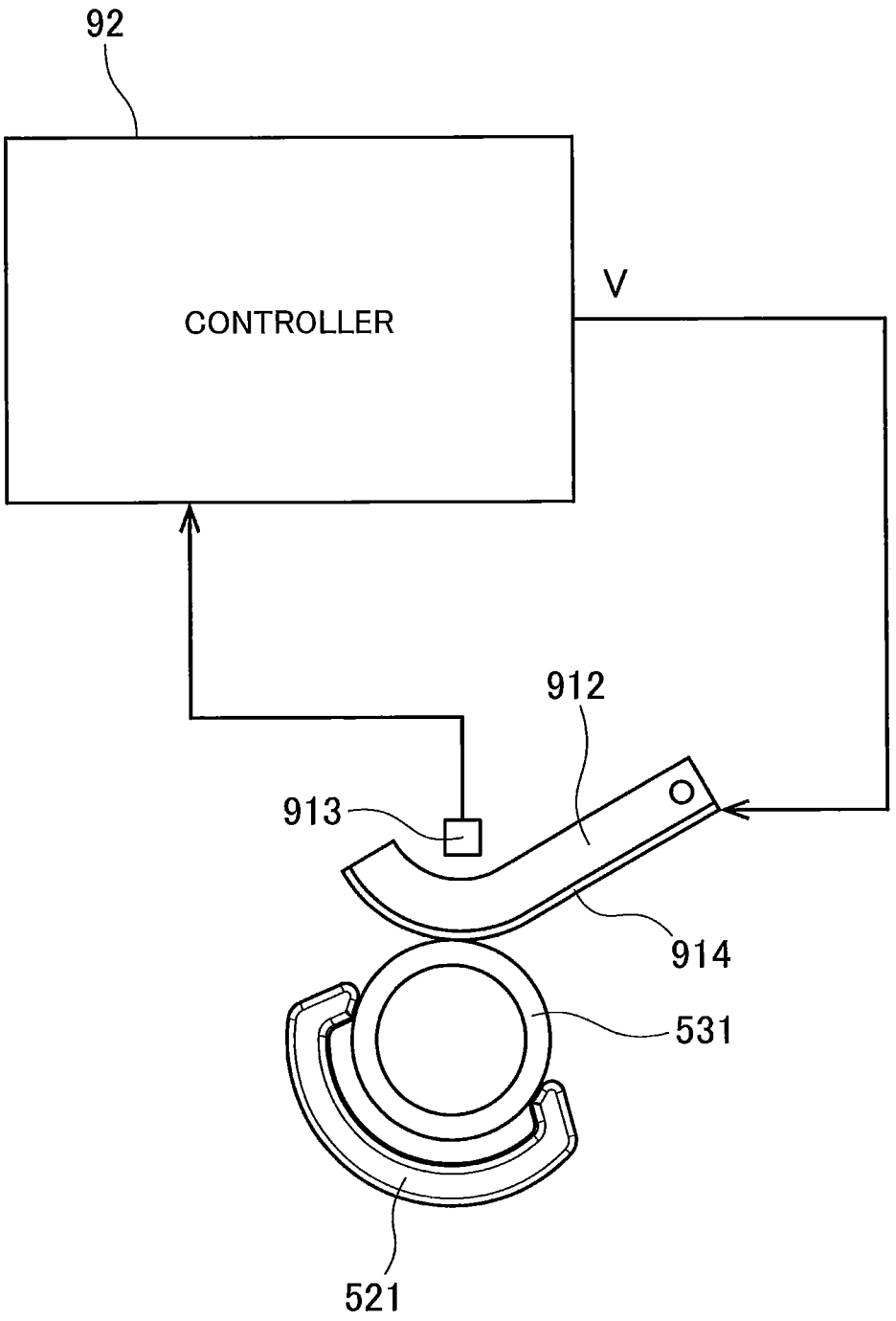
FIG. 8 is a view for description of a relationship among a first protrusion, a gear shaft, a lever, an optical sensor, and a controller according to the embodiment.
Figure 9:
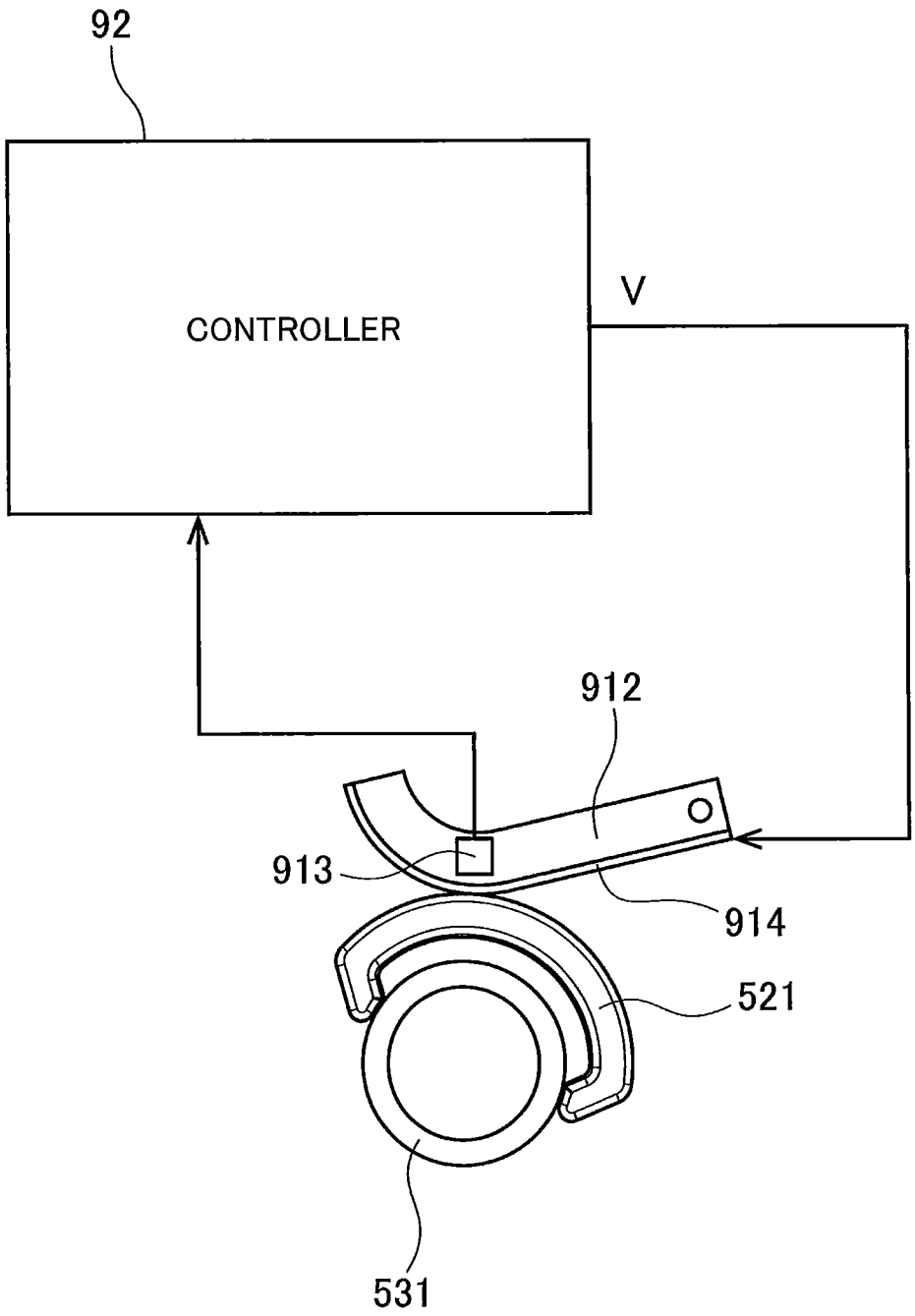
FIG. 9 is a view for description of the relationship among the first protrusion, the gear shaft, the lever, the optical sensor, and the controller according to the embodiment.

The drawer unit 91 includes the lever 912 and an optical sensor 913. FIGS. 8 and 9 illustrate a relationship among the first protrusion 521, the gear shaft 531, the lever 912, the optical sensor 913, and the controller 92. The lever 912 can contact with one of the gear shaft 531 and the first protrusion 521.

The lever 912 has a surface to which an electrically conductive metal plate 914 is attached. Electric power is supplied from the controller 92 to the metal plate 914. When the metal plate 914 is brought into contact with the gear shaft 531 as illustrated in FIG. 8, the metal plate 914, the electrically conductive member 53, and the developing roller shaft 32 are electrically connected to each other. During driving state of the image forming apparatus 100, the developing roller shaft 32 is applied with a predetermined bias voltage by electric power supplied from the metal plate 914.

As described above, the first protrusion 521 covers a portion of the outer peripheral surface of the gear shaft 531. Therefore, contacting state between the metal plate 914 and the gear shaft 531 is changed in accordance with the shape of the detection gear 52 during rotation of the detection gear 52 after attachment of a new developing cartridge 1 to the drawer unit 91. That is, the metal plate 914 is temporarily separated from the gear shaft 531 and is brought into contact only with the first protrusion 521 as illustrated in FIG. 9. In this way, the lever 912 is moved between a first position where the metal plate 914 is in contact with the gear shaft 531 and a second position where the metal plate 914 is separated from the gear shaft 531.

The optical sensor 913 is configured to detect a displacement of the lever 912 and transmit detection signals to the controller 92. The optical sensor 913 is a sensor unit having a light emitting portion and a light receiving portion. When the lever 912 is at the first position, light from the light emitting portion can be received in the light receiving portion without being interrupted by the lever 912. On the other hand, when the lever 912 is at the second position, the light from the light emitting portion is interrupted by the lever 912, so that the light cannot enter the light receiving portion. In this way, the optical sensor 913 can specify the position of the lever 912 to one of the first position and the second position in accordance with the entry or non-entry of the light at the light receiving portion. On the basis of the signals from the optical sensor 913, the controller 92 determines whether the attached developing cartridge 1 is a new cartridge or not, and/or recognizes the specification of the attached developing cartridge 1.

In this way, the optical sensor 913 detects movement of the first protrusion 521 via the lever 912. However, the optical sensor 913 can directly detect the movement of the first protrusion 521. Further, instead of the optical sensor 913, a magnetic sensor and a contact type sensor may be used. Further, movement of the first protrusion 521 can be detected on the basis of electrical connection or disconnection between the optical sensor 913 and the gear shaft 531.

In the embodiment, the gear shaft 531 is a portion of the electrically conductive member 53. Alternatively, a gear shaft may be provided independently from a power supply route to the electrically conductive member 53. For example, the second end face 12 of the casing 10 may have a through-hole that a cap covers, and a gear shaft may be positioned on the cap so as to extend from the cap in the first direction.

4.1 IC Chip Assembly

The IC chip assembly 60 is positioned at an outer side of the first end face 11 of the casing 10. As illustrated in FIGS. 3 through 6, the IC chip assembly 60 includes the cartridge IC 61 and the holder 62. The cartridge IC 61 is fixed to an outer surface of the holder 62 that is held to the first cover 45. The cartridge IC 61 has an electrical contact surface, which is made from an electrically conductive metal. The cartridge IC 61 includes a memory as a storage medium. Various information related to the developing cartridge 1 can be stored in the memory of the cartridge IC 61.

In the drawer unit 91, each of the slots 910 has an electrical connector. Each connector is electrically connected to the controller 92. As a result of the attachment of the developing cartridge 1 to the drawer unit 91, the electrical connector of the drawer unit 91 contacts the electrical contact surface of the cartridge IC 61, so that the reading out information from the cartridge IC 61 and writing information to the cartridge IC 61 can be achieved in the image forming apparatus 100.

Figure 10:
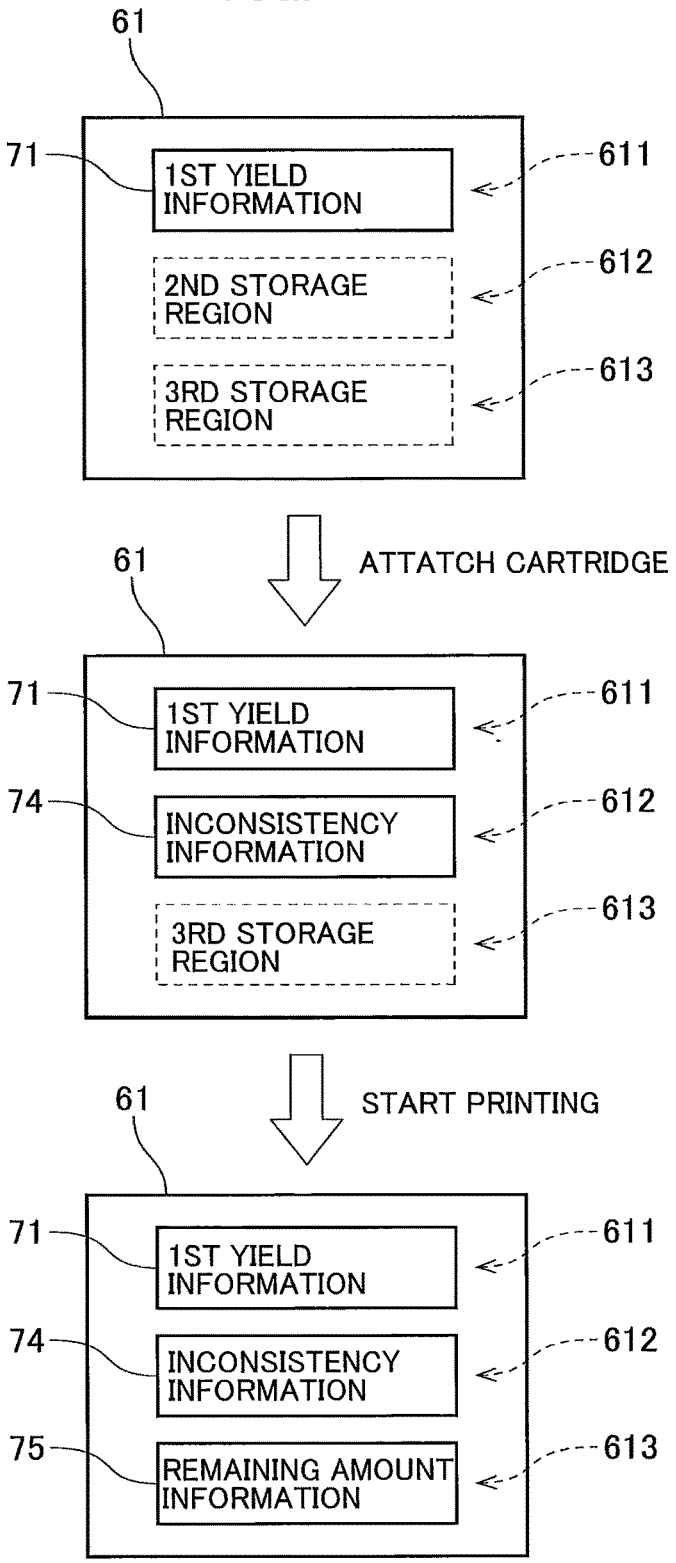
FIG. 10 is a conceptual diagram illustrating a storage region of a memory in a cartridge IC according to the embodiment.

As illustrated in FIG. 10, the cartridge IC 61 includes a first storage region 611, a second storage region 612, and a third storage region 613. The cartridge IC 61 stores therein a first yield information 71 representing the amount of developing agent accommodated in the developing cartridge 1, or a the number of printable sheets with the developing agent in the developing cartridge 1. The second storage region 612 is configured to store therein inconsistency information 74. The inconsistency information 74 represents inconsistency between the first yield information 71 and second yield information 72 obtained from the first protrusion 521 in the processing of steps S1 through S19 described later. The third storage region 613 is configured to store therein remaining amount information 75 representing the remaining amount of the developing agent accommodated in the developing cartridge 1. The second yield information 72 represents the amount of developing agent accommodated in the developing cartridge 1 or a the number of printable sheets with the developing agent in the developing cartridge 1 which is determined based on the detection gear 52.

Before shipment, in the developing cartridge 1 (which also includes a recycled developing cartridge) the first yield information 71 has been stored in the first storage region 611, whereas the inconsistency information 74 and the remaining amount information 75 have not been stored in the second storage region 612 and the third storage region 613, respectively.

5. Controller

Figure 11:
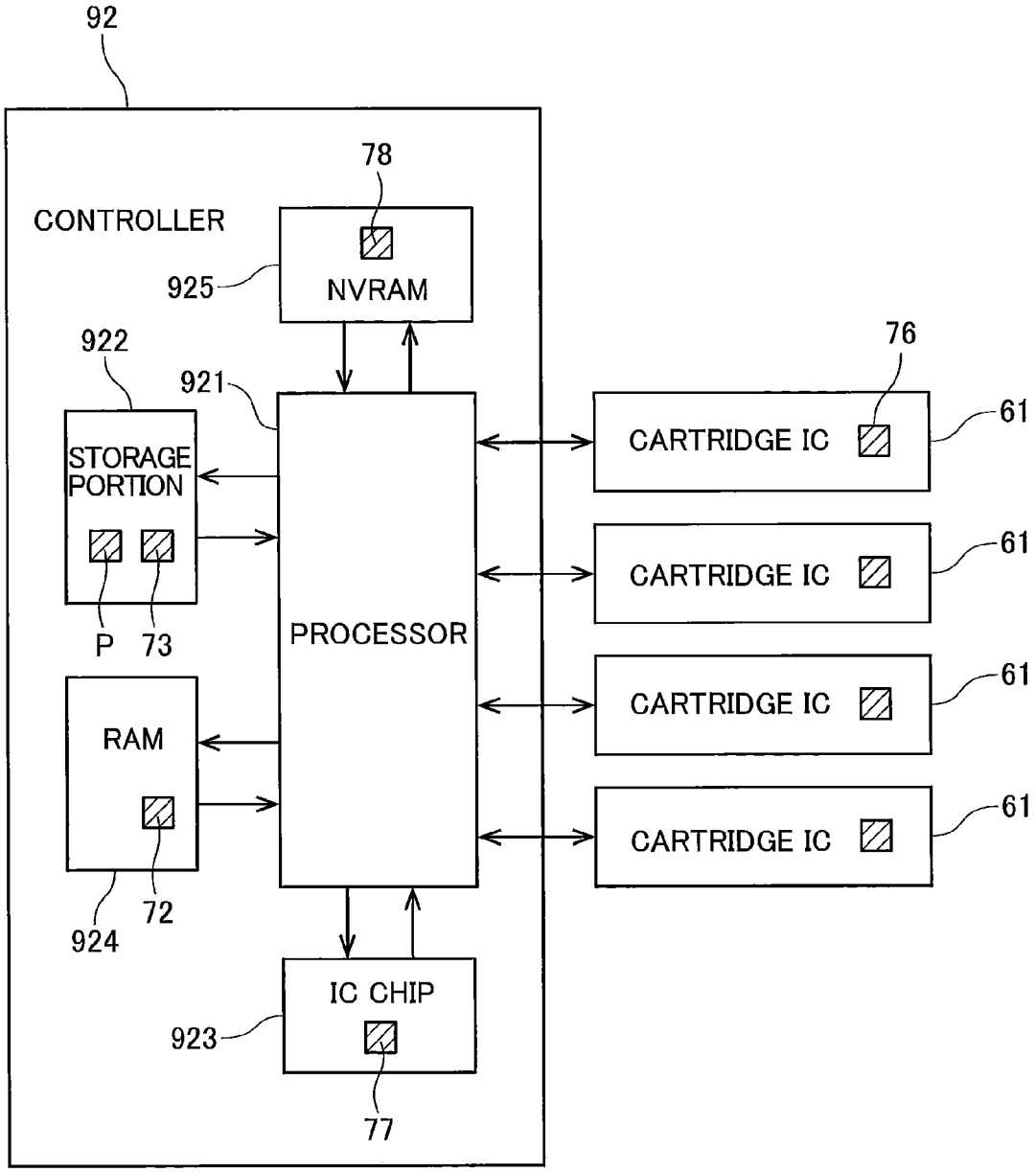
FIG. 11 is a conceptual block diagram illustrating a connection between the controller and the four cartridge ICs according to the embodiment.

As illustrated in FIG. 11, the controller 92 includes a processor 921, a storage portion 922, a IC chip 923, a RAM 924, and a NVRAM 925. The processor 921 is an arithmetic processing unit such as a CPU. The processor 921 is configured to write information into and read information from the storage portion 922, the IC chip 923, the RAM 924, and the NVRAM 925. Further, the processor 921 can perform writing and/or reading with respect to four cartridge ICs 61. The storage portion 922 stores program P to be retrieved by the processor 921. The controller 92 is operated by executing the program P read from the storage portion 922 by the processor 921.

Each of the four cartridge ICs 61 stores first authentication information 76. Further, the IC chip 923 stores therein second authentication information 77 corresponding to the first authentication information 76. In an authentication processing described later, the processor 921 determines success or failure of the authentication using the first authentication information 76 stored in the cartridge IC 61 and the second authentication information 77 stored in the IC chip 923.

The RAM 924 is a volatile memory capable of reading and writing information. The processor 921 sorts out information stored in the cartridge IC 61 into the RAM 924. Consequently, the processor 921 can promptly read information stored in the cartridge IC 61 from the RAM 924. Further, the processor 921 temporarily writes, in the RAM 924, information that should be written in the cartridge IC 61, and then copies the information from the RAM 924 to the cartridge IC 61.

The controller 92 permits the RAM 924 to store the second yield information 72 obtained by new cartridge detection processing described later. Further, the storage portion 922 provisionally stores third yield information 73 which is referred in steps S7 or S19 described later. The third yield information 73 represents the amount of developing agent consumable by the developing cartridge 1 or the number of printable sheets with the developing agent. Here, the amount of developing agent represented by the third yield information 73 is preferably smaller than the amount of developing agent represented by the first yield information 71 or the second yield information 72. Further, the number of printable sheets represented by the third yield information 73 is preferably smaller than the number of printable sheets represented by the first yield information 71 or the second yield information 72.

The NVRAM 925 is a non-volatile memory capable of storing information even at shut off state of electric power. The NVRAM 925 stores therein information related to the developing cartridge 1. When a new developing cartridge 1 is attached to the image forming apparatus 100, the processor 921 initializes information related to the developing cartridge 1 stored in the NVRAM 925.

In the embodiment, when a process for detecting new cartridge described later is started, flag information is stored in the NVRAM 925. The flag information is deleted from the NVRAM 925, when the process for detection of new cartridge is terminated. Flag information still stores in the NVRAM 925 at accidental power shut off during detection of new cartridge. This flag information can be referred to as halt information 78 which represents power shut off during detection of new cartridge is occurred.

6. Process Executed After Attachment of Developing Cartridge

Figure 12:
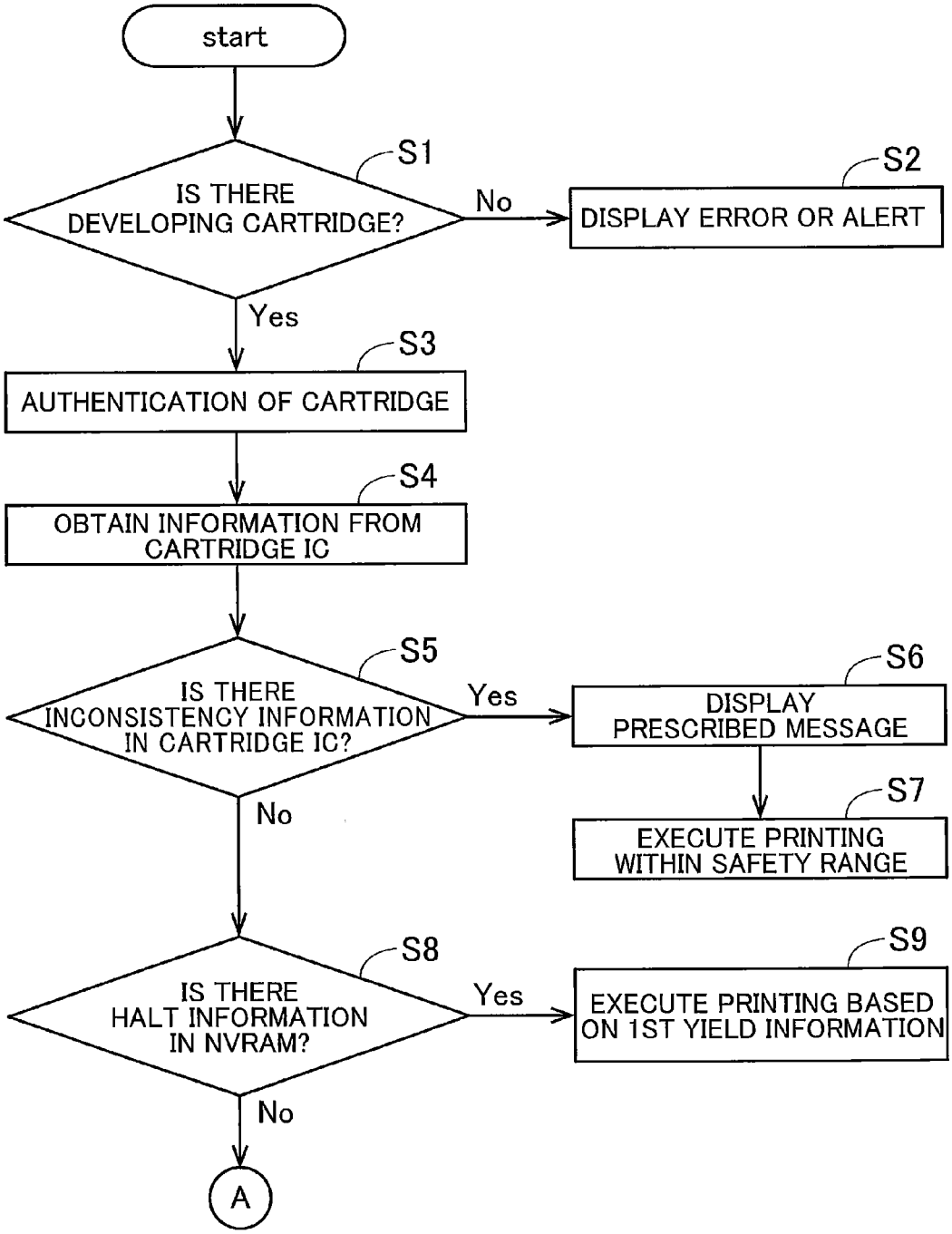
FIG. 12 is a flowchart illustrating a processing routine executed after attachment of the developing cartridge according to the embodiment.
Figure 13:
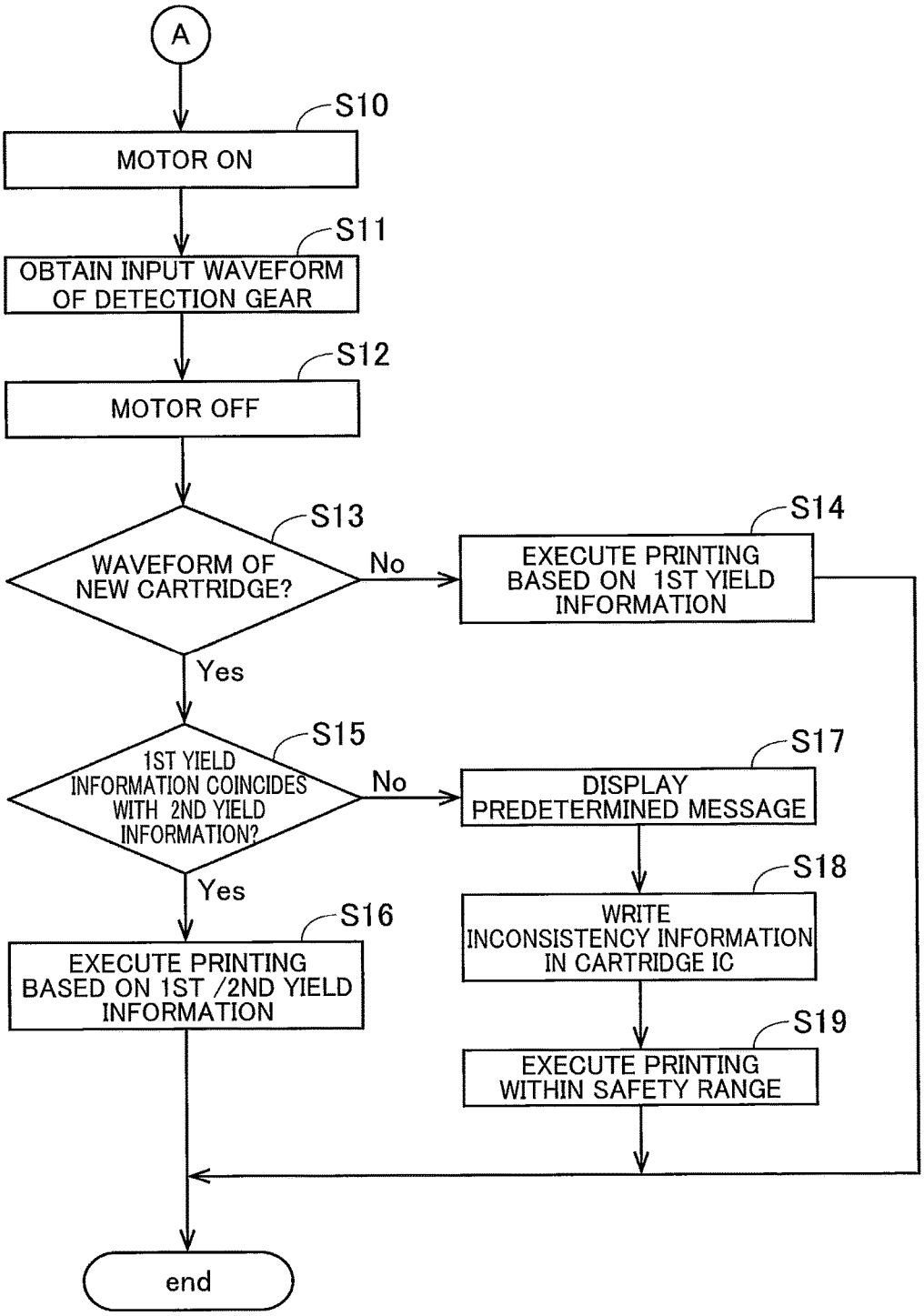
FIG. 13 is a flowchart illustrating the processing routine executed after attachment of the developing cartridge according to the embodiment.

Next, processing executed after attachment of the developing cartridge 1 will be described with reference to flowcharts illustrated in FIGS. 12 and 13. The following processing in the controller 92 is executed by the processor 921 in accordance with the program P. Further, the following description describes processing with respect to one developing cartridge 1. Similar processing is executed with respect to each of the four developing cartridges 1.

When the developing cartridge 1 is attached to the drawer unit 91, and the drawer unit 91 is accommodated in the image forming apparatus 100, the controller 92 confirms existence of the developing cartridge 1 (S1). The image forming apparatus 100 includes a cartridge sensor (not shown) for detecting existence of the developing cartridge 1 at each of the slots 910 of the drawer unit 91. The controller 92 determines existence of the developing cartridge 1 in each slot 910 on the basis of signal output from the cartridge sensor. Incidentally, the controller 92 can determine the existence of the developing cartridge 1 by making use of signal output from the optical sensor 913.

When the developing cartridge 1 is not set at the slot 910 of the drawer unit 91 (S1: No), the controller 92 displays error or warning in the display 93 (S2). Accordingly, the controller 92 notifies to a user of non-attachment of the developing cartridge 1 or insufficient attachment of the developing cartridge 1 to the slot 910 of the drawer unit 91.

On the other hand, when the drawer unit 91 determines that the developing cartridge 1 exists in the slot 910 of the drawer unit 91 in S1, the drawer unit 91 authenticates the cartridge IC 61 (S3).

When the authentication to the cartridge IC 61 becomes successful, the controller 92 obtains information from the cartridge IC 61 (S4). More specifically, the controller 92 writes, in the RAM 924, information stored in the cartridge IC 61. In the embodiment, the controller 92 copies the first yield information 71 stored in the first storage region 611 into the RAM 924. If the inconsistency information 74 is stored in the second storage region 612, the controller 92 also copies the inconsistency information 74 into the RAM 924. If the remaining amount information 75 is stored in the third storage region 613, the controller 92 also copies the remaining amount information 75 into the RAM 924.

However, when a new developing cartridge 1 is attached to the image forming apparatus 100 for the first time, no inconsistency information 74 and the remaining amount information 75 are stored in the cartridge IC 61. In the latter case, only the first yield information 71 is copied into the RAM 924. On the other hand, when the developing cartridge 1 that has been used is temporarily detached from the image forming apparatus 100 and is then attached to the image forming apparatus 100, the cartridge IC 61 may store inconsistency information 74 and the remaining amount information 75 as well as inconsistency information 74. In the latter case, not only the first yield information 71 but also the inconsistency information 74 and the remaining amount information 75 are written in the RAM 924.

Next, the controller 92 confirms as to whether the inconsistency information 74 is stored in the second storage region 612 by identifying the information in the RAM 924 (S5). When the inconsistency information 74 is stored in the RAM 924, the controller 92 determines that the second storage region 612 stores the inconsistency information 74. The inconsistency information 74 represents that the detection of a new cartridge (described later) is carried at least once, and the first yield information 71 stored in the cartridge IC 61 is not coincident with the second yield information 72 obtained from the detection gear 52. This is special states different from ordinary states.

When the inconsistency information 74 is stored in the RAM 924 (S5: Yes), the controller 92 permits the display 93 to display a prepared message (S6). Accordingly, the user can recognize the special states.

After the step S6, the controller 92 checks the first yield information 71 and the second yield information 72 which are stored in the RAM 924. Then the controller 92 executes print processing on the basis of the smaller one of the amount of developing agent represented by the first yield information 71 and the amount of developing agent represented by the second yield information 72, or executes print processing on the basis of the smaller one of the number of printable sheets represented by the first yield information 71 and the number of printable sheets represented by the second yield information 72. Alternatively, the controller 92 may execute print processing on the basis of the amount of developing agent or the number of printable sheets represented by the third yield information 73 stored in the storage portion 922. As a result, the controller 92 executes print processing within a tolerable range (S7).

On the other hand, in S5, when the inconsistency information 74 is not stored in the RAM 924 (S5: No), then, the controller 92 checks as to whether the halt information 78 is stored in the NVRAM 925 (S8). The halt information 78 is the flag information that is not deleted from the NVRAM 925. The halt information 78 represents that detection of new cartridge (described later) has been carried out at least once, and power supply to the image forming apparatus 100 is shut off during detection of the new cartridge. In this case, reliability of the second yield information 72 obtained by the process for detection of the new cartridge is presumably low.

Therefore, if the halt information 78 is stored in the NVRAM 925 (S8:Yes), the controller 92 executes print processing on the basis of the amount of the developing agent or the number of printable sheets represented by the first yield information 71 stored in the RAM 924 (S9).

On the other hand, when the halt information 78 is not stored in the NVRAM 925 (S8: No), the controller 92 executes the process for detection of a new cartridge with respect to four developing cartridges 1. More specifically, the controller 92 permits the motor to start its driving to rotate the drive shaft (S10). Then, the rotation of the drive shaft is transmitted to the detection gear 52 through the first agitator gear 44, agitator 20, and the second agitator gear 51. Thus, the detection gear 52 starts rotation. By the rotation of the detection gear 52, the first protrusion 521 is moved. Inclination of the lever 912 is changed in accordance with the movement of the first protrusion 521. The optical sensor 913 transmits to the controller 92 the detection signal changing in accordance with the movement of the lever 912. Accordingly, the controller 92 obtains input signals changing in accordance with the rotation of the detection gear 52 (S11).

Then, when the meshing engagement between the second agitator gear 51 and the detection gear 52 is released, rotation of the detection gear 52 is stopped. Further, the controller 92 stops driving of the motor after elapse of predetermined time period after start timing of driving the motor (S12).

Then, the controller 92 determines whether the obtained input signals are signals representing the developing cartridge 1 is new (S13). If the obtained input signals are not the signals representing the developing cartridge 1 is new (S13: No), it is assumed that the developing cartridge 1 which has been used in the image forming apparatus 100 is detached from the image forming apparatus 100 and then is attached to the image forming apparatus 100 again. In this case, the controller 92 executes print processing on the basis of the amount of developing agent or the number of printable sheets represented by the first yield information 71 stored in the RAM 924 (S14).

On the other hand, if the obtained input signals are the signals representing the developing cartridge 1 is new (S13: Yes), then, the controller 92 determines whether the first yield information 71 stored in the RAM 924 is coincident with the second yield information 72 determined based on the obtained input signals (S15).

If the first yield information 71 and the second yield information 72 are coincident with each other (S15: Yes), the controller 92 determines that the present state is normal state. In this case, the controller 92 executes print processing on the basis of one of the amount of developing agent represented by the first yield information 71 and that represented by the second yield information 72 (S16), or executes print processing on the basis of one of the number of printable sheets represented by the first yield information 71 and that represented by the second yield information 72 (S16).

On the other hand, if the first yield information 71 stored in the RAM 924 is not coincident with the second yield information 72 determined based on the obtained input signals (S15: No), it is assumed that the present state is presumably a special states different from ordinary states. In such a case, the controller 92 displays message already prepared (S17). This can notify the user of the special states.

After S17, the controller 92 writes the inconsistency information 74 into the cartridge IC 61 (S18). More specifically, the processor 921 writes the inconsistency information 74 in the RAM 924. Then, the inconsistency information 74 in the RAM 924 is written in the cartridge IC 61 on a periodic basis or on a case by case basis. That is, the inconsistency information 74 is written in the second storage region 612 of the cartridge IC 61.

Incidentally, in the embodiment, the controller 92 writes the inconsistency information 74 into the cartridge IC 61 only when the first yield information 71 is not coincident with the second yield information 72. Alternatively, the controller 92 can write coincidence information in the cartridge IC 61 when the first yield information 71 and the second yield information 72 are coincident with each other. That is, in S18, the controller 92 writes, in the second storage region 612 of the cartridge IC 61, the yield confirmation information representing a result of confirmation as to whether the inconsistency between the first yield information 71 and the second yield information 72 has existed.

After S18, the controller 92 checks the first yield information 71 and the second yield information 72 those stored in the RAM 924. The controller 92 executes print processing on the basis of the smaller one of the amount of developing agent represented by the first yield information 71 and the amount of developing agent represented by the second yield information 72, or executes print processing on the basis of the smaller one of the number of printable sheets represented by the first yield information 71 and the number of printable sheets represented by the second yield information 72. Alternatively, the controller 92 executes print processing on the basis of the amount of developing agent or the number of printable sheets represented by the third yield information 73 stored in the storage portion 922. Accordingly, the controller 92 executes print processing (S19).

In this way, the amount of the developing agent or the number of printable sheets in the developing cartridge 1 can be checked on the basis of the first yield information 71 stored in the cartridge IC 61 and the second yield information 72 obtained from the first protrusion 521 of the detection gear 52. Thus, the controller 92 can determine the amount of the developing agent or the number of printable sheets those to be referred to during the execution of the print processing. Thus, the image forming apparatus 100 performs printing on the basis of the determined amount of developing agent or numbers of printing sheets.

Consequently, print processing can be executed under special states.

7. Remaining Amount Update Process

Figure 14:
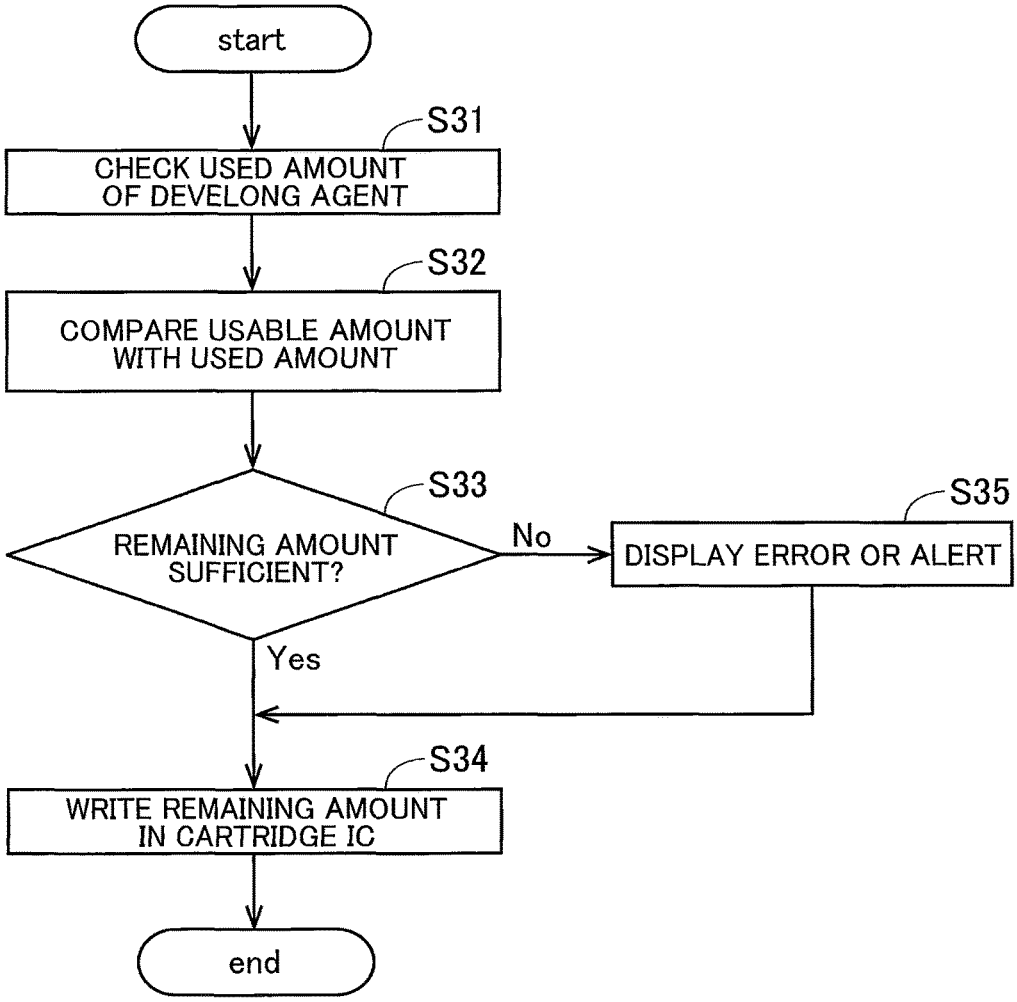
FIG. 14 is a flowchart illustrating a processing routine for renewal of information as to residual amount according to the embodiment.

Next, a process for updating the remaining amount information 75 stored in the third storage region 613 of the cartridge IC 61 will be described with reference to a flowchart illustrated in FIG. 14. The controller 92 repeatedly executes update process for updating the remaining amount information 75 at a prescribed timing after completion of S1 through S19.

When executing the process for updating the remaining amount information 75, the controller 92 checks used amount of the developing agent (S31). The controller 92 stores information representing the used amount of the developing agent into the RAM 924, and updates the used amount of the developing agent whenever the print processing is executed. Further, the information representing amount of the developing agent determined in S7, S9, S14, S16 or S19 is stored in the RAM 924.

Then, the controller 92 compares the first yield information or the second yield information representing the amount of developing agent accommodated in the developing cartridge 1 and the information representing the used amount of the developing agent those stored in the RAM 924 (S32). Thus, the controller 92 determines the remaining amount information 75 representing the remaining amount of the developing agent in the developing cartridge 1. For example, the controller 92 subtracts the used amount of the developing agent represented by the information stored in RAM 924 from the amount of developing agent represented by the first yield information or the second yield information stored in the RAM 924 to compute the remaining amount information 75.

After the controller 92 determines the remaining amount information 75, the controller 92 determines whether the remaining amount of the developing agent represented by the remaining amount information 75 is sufficient for continuing the print processing (S33). More specifically, the controller 92 determines whether the remaining amount of the developing agent represented by the remaining amount information 75 is not more than a threshold value stored in the NVRAM 925. If the remaining amount of the developing agent is more than the threshold value, (S33: Yes), the controller 92 determines that the sufficient amount of the developing agent still remains in the developing cartridge 1. In this case, the controller 92 writes the remaining amount information 75 in the cartridge IC 61 (S34) and waits the subsequent input of print instruction. In S34, the processor 921 writes the remaining amount information 75 in the RAM 924. Then, the controller 92 writes, in the third storage region 613 of the cartridge IC 61, the remaining amount information 75 stored in the RAM 924 on a periodic basis or on a case by case basis.

On the other hand, if the controller 92 determines that the remaining amount of the developing agent is not more than the threshold value (S33: No), the controller 92 determines that the remaining amount is insufficient. In this case, the controller 92 permits the display 93 to display error or warning (S35), and then writes the remaining amount information 75 into the cartridge IC 61 (S34).

8. Modifications

Various modifications are conceivable.

8-1. First Modification

Figure 15:
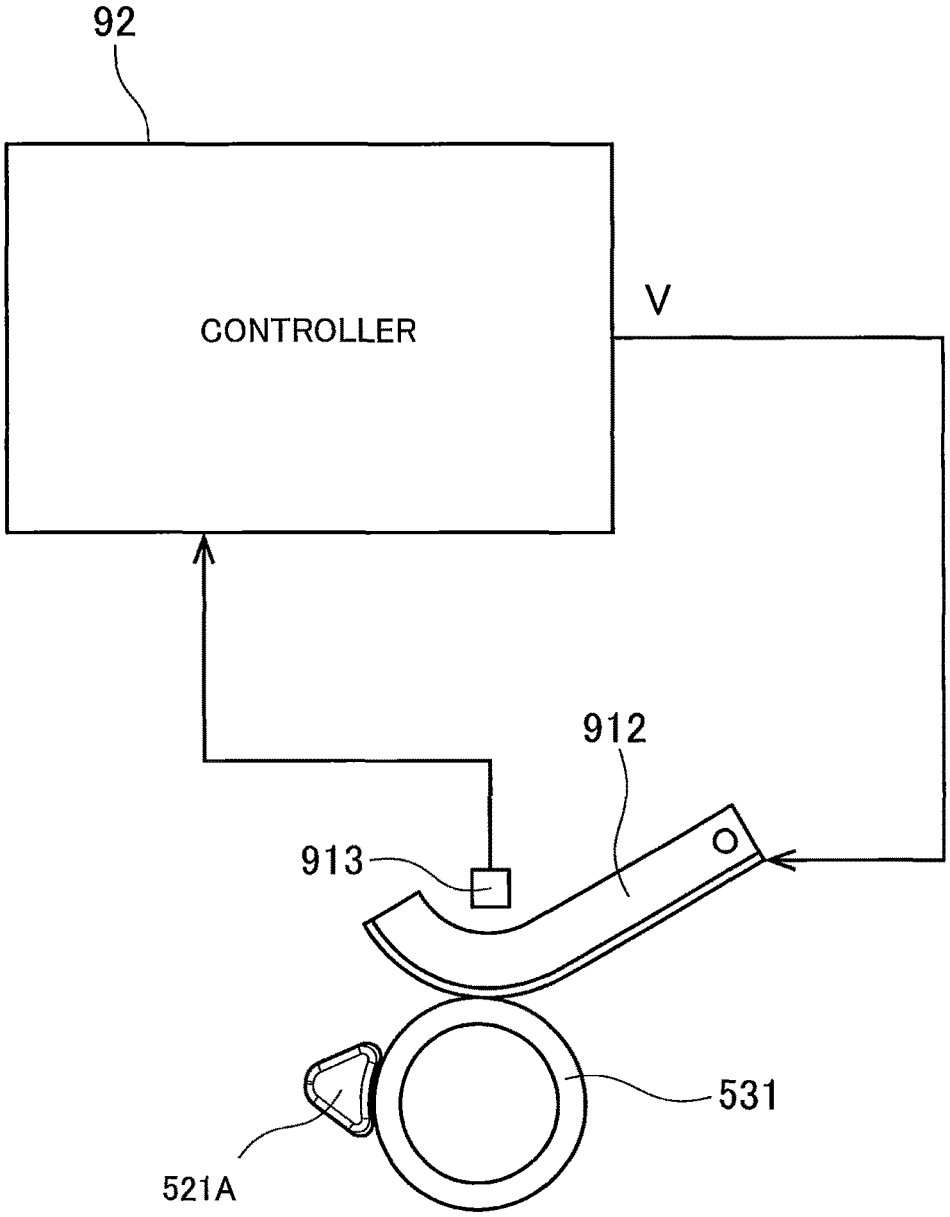
FIG. 15 is a view for description of a relationship among a first protrusion, a gear shaft, a lever, an optical sensor and a controller according to a first modification.

FIG. 15 illustrates a first modification wherein like parts and components are designated by the same reference numerals as those shown in the first embodiment. A relationship among a first protrusion 521A corresponding to the first protrusion 521, the gear shaft 531, the lever 912, the optical sensor 913, and the controller 92 is shown in FIG. 15. The first protrusion 521A has a circumferential length smaller than the circumferential length of the first protrusion 521 of the above-described embodiment. Accordingly, a time period during which the lever 912 is separated from the gear shaft 531 is shorter than the time period caused in the above-described embodiment. In this way, arcuate shape of the first protrusion 521 is not necessarily required.

8-2. Second Modification

Figure 16:
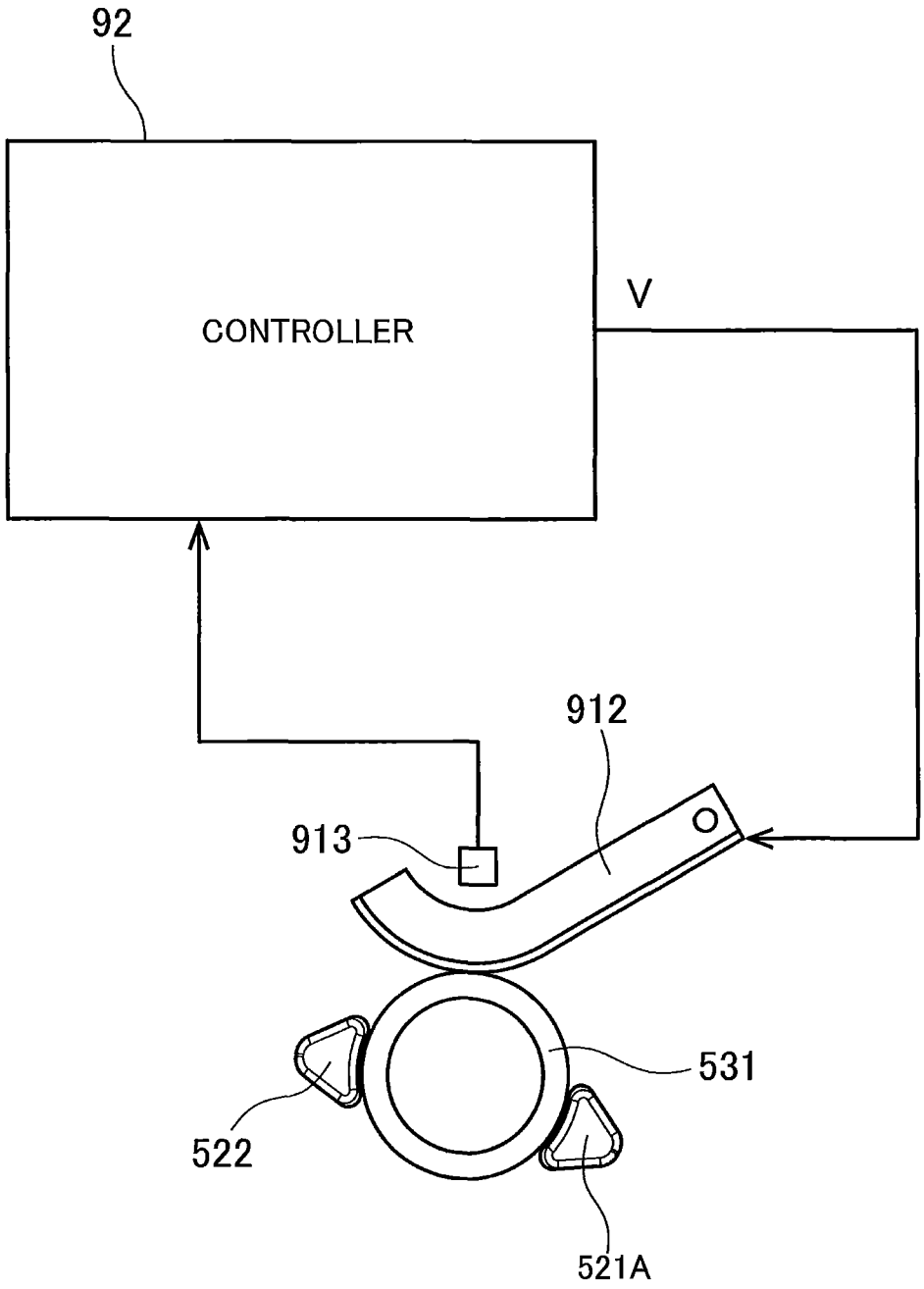
FIG. 16 is a view for description of a relationship among a first protrusion, a second protrusion, a gear shaft, a lever, an optical sensor and a controller according to a second modification.

FIG. 16 illustrates a second modification wherein like parts and components are designated by the same reference numerals as those shown in the first embodiment. A relationship among the first protrusion 521A, a second protrusion 522, the gear shaft 531, the lever 912, the optical sensor 913, and the controller 92 is shown in FIG. 16. According to the second modification, the detection gear 52 includes the first protrusion 521A, and the second protrusion 522. These protrusions 521A, 522 are positioned at circumferential positions different from each other and protrude in the first direction respectively. The first protrusion 521A has an outer end portion (first outer end portion) in a radial direction of the detection gear 52, and the second protrusion 522 has an outer end portion (second outer end portion) away from the first outer end portion in the circumferential direction of the detection gear 52.

When the developing cartridge 1 is attached to the image forming apparatus 100 and the detection gear 52 is rotated, positions of the first protrusion 521A and the second protrusion 522 are changed along with the detection gear 52. Therefore, the first protrusion 531A is brought into contact with the lever 912. Further, the second protrusion 522 is brought into contact with the lever 912 after or prior to the contact of the first protrusion 531A with the lever 912. Accordingly, in accordance with the rotation of the detection gear 52, the lever 912 is moved from the first position to the second position twice. The optical sensor 913 detects the movement of the lever 912 two times.

In this way, providing two projections at the detection gear 52 can change detection signal from the optical sensor in accordance with the distance between the protrusions and lengths of the protrusions in the circumferential direction. Consequently, positions and shapes of the two protrusions can provide various types of the second yield information.

8-3. Third Modification

Figure 17:
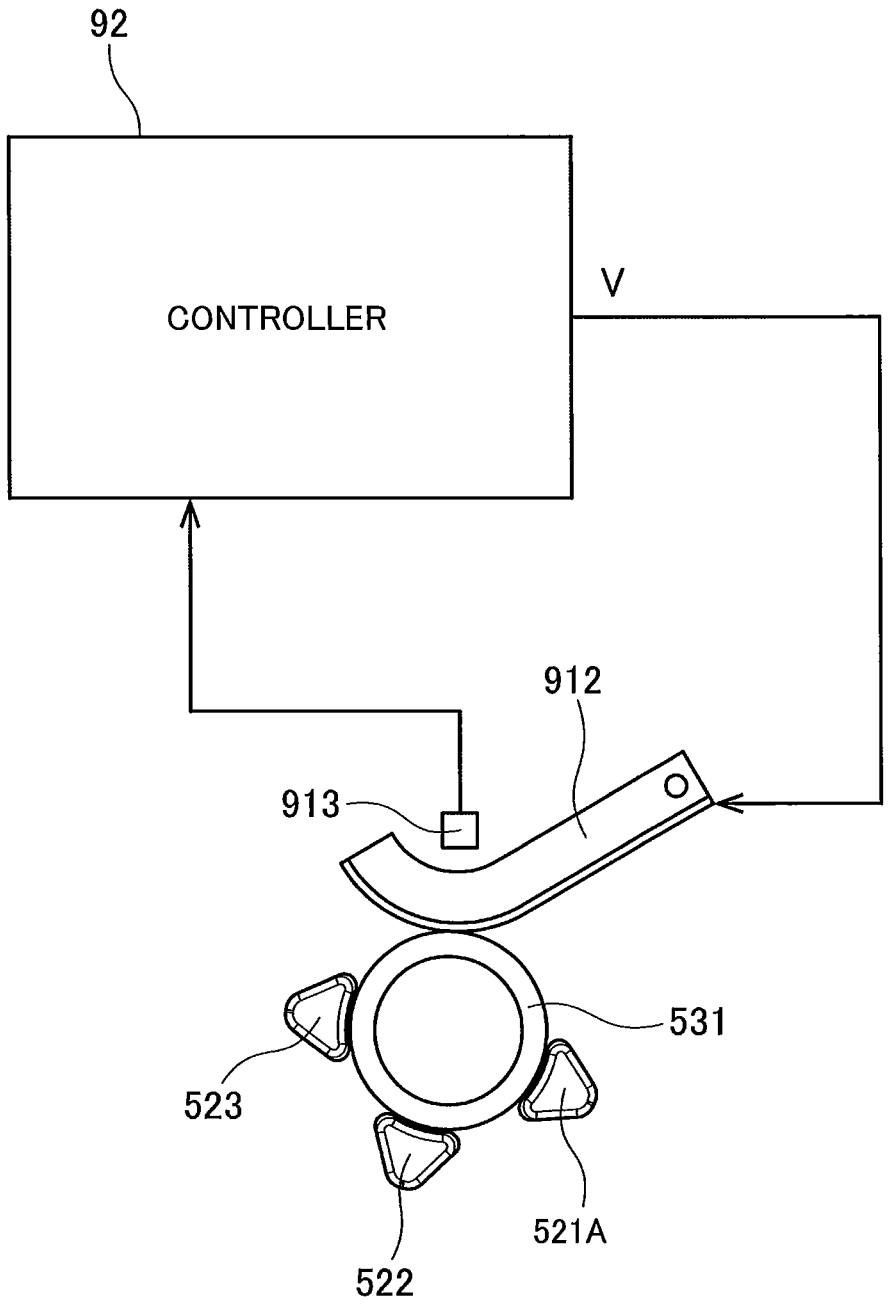
FIG. 17 is a view for description of a relationship among a first protrusion, a second protrusion, a third protrusion, a gear shaft, a lever, an optical sensor and a controller according to a third modification.

FIG. 17 illustrates a third modification wherein like parts and components are designated by the same reference numerals as those shown in the first embodiment. A relationship among the first protrusion 521A, the second protrusion 522, a third protrusion 523, the gear shaft 531, the lever 912, the optical sensor 913, and the controller 92 is shown in FIG. 17. According to the third modification, the detection gear 52 includes the first protrusion 521A, the second protrusion 522 and the third protrusion 523. These protrusions 521A, 522, 523 are positioned at circumferential positions different from each other. When the detection gear 52 is rotated, positions of the first protrusion 531A, the second protrusion 522 and the third protrusion 523 are changed along with the detection gear 52. Therefore, the first protrusion 531A is brought into contact with the lever 912. Further, the second protrusion 522 is brought into contact with the lever 912 after or prior to the contact of the first protrusion 531A with the lever 912. Accordingly, in accordance with the rotation of the detection gear 52, the lever 912 is moved from the first position to the second position thrice. The optical sensor 913 detects the movement of the lever 912 three times.

In this way, providing three projections at the detection gear 52 can change detection signal from the optical sensor in accordance with a distance between the protrusions and lengths of the protrusions in the circumferential direction. Consequently, positions and shapes of the three protrusions can provide various types of the yield information. Incidentally, not less than four protrusions can be provided at the detection gear 52.

8-4. Fourth Modification

Figure 18:
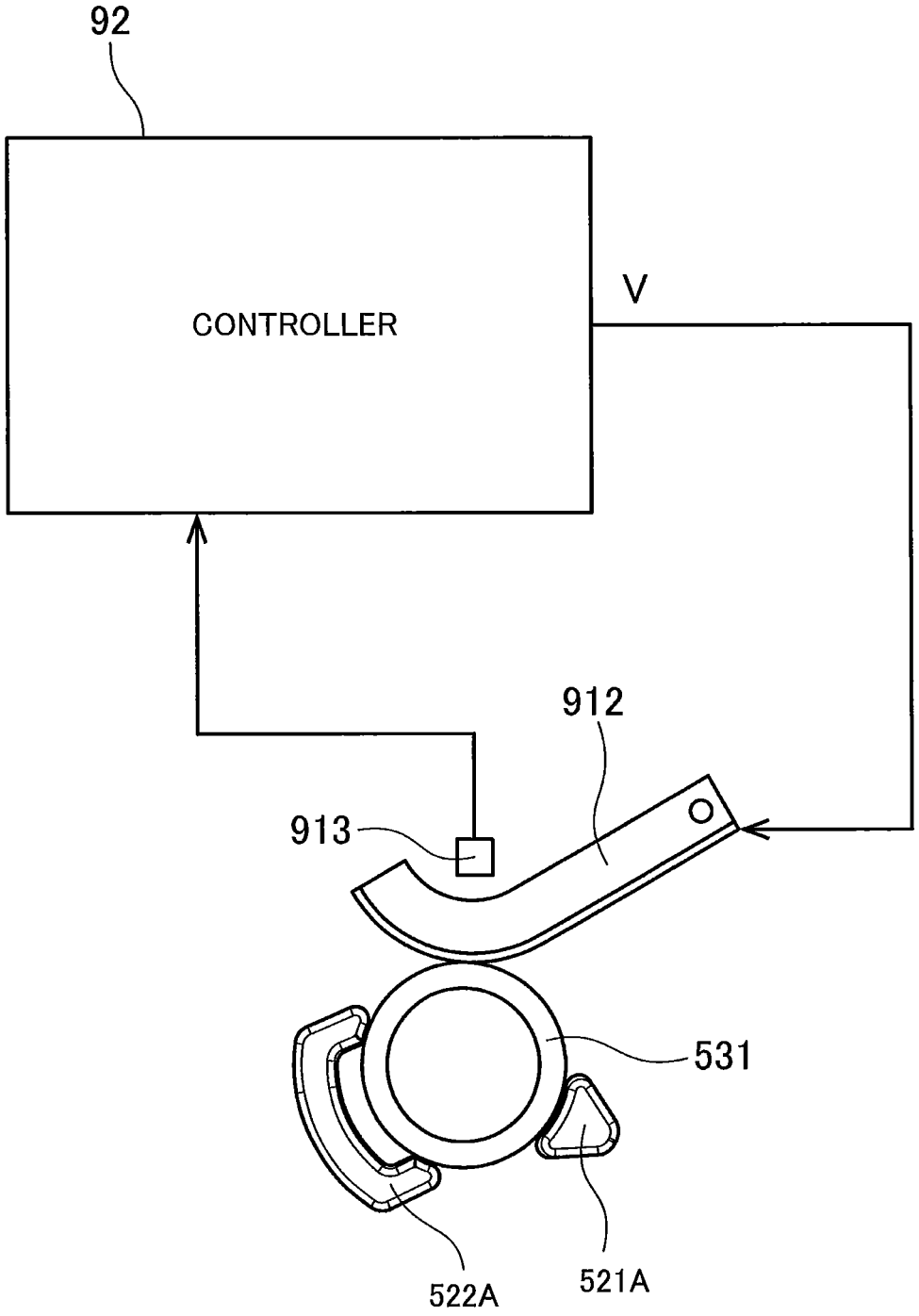
FIG. 18 is a view for description of a relationship among a first protrusion, a second protrusion, a gear shaft, a lever, an optical sensor and a controller according to a fourth modification.

FIG. 18 illustrates a fourth modification wherein like parts and components are designated by the same reference numerals as those shown in the first embodiment. A relationship among the first protrusion 521A, a second protrusion 522A, the gear shaft 531, the lever 912, the optical sensor 913, and the controller 92 is shown in FIG. 18. According to the fourth modification, the detection gear 52 includes the first protrusion 521A, and the second protrusion 522A. These protrusions 521A, 522A are positioned at circumferential positions different from each other and protrude in the first direction respectively. The first protrusion 521A has an outer end portion (first outer end portion) in the radial direction of the detection gear 52, and the second protrusion 522A has an outer end portion (second outer end portion) away from the first outer end portion in the circumferential direction of the detection gear 52.

When the developing cartridge 1 is attached to the image forming apparatus 100 and the detection gear 52 is rotated, positions of the first protrusion 531A and the second protrusion 522A are changed along with the detection gear 52. Therefore, the first protrusion 531A is brought into contact with the lever 912. Further, the second protrusion 522A is brought into contact with the lever 912 after or prior to the contact of the first protrusion 531A with the lever 912. Accordingly, in accordance with the rotation of the detection gear 52, the lever 912 is moved from the first position to the second position twice. The optical sensor 913 detects the twice movement of the lever 912.

Figure 19:
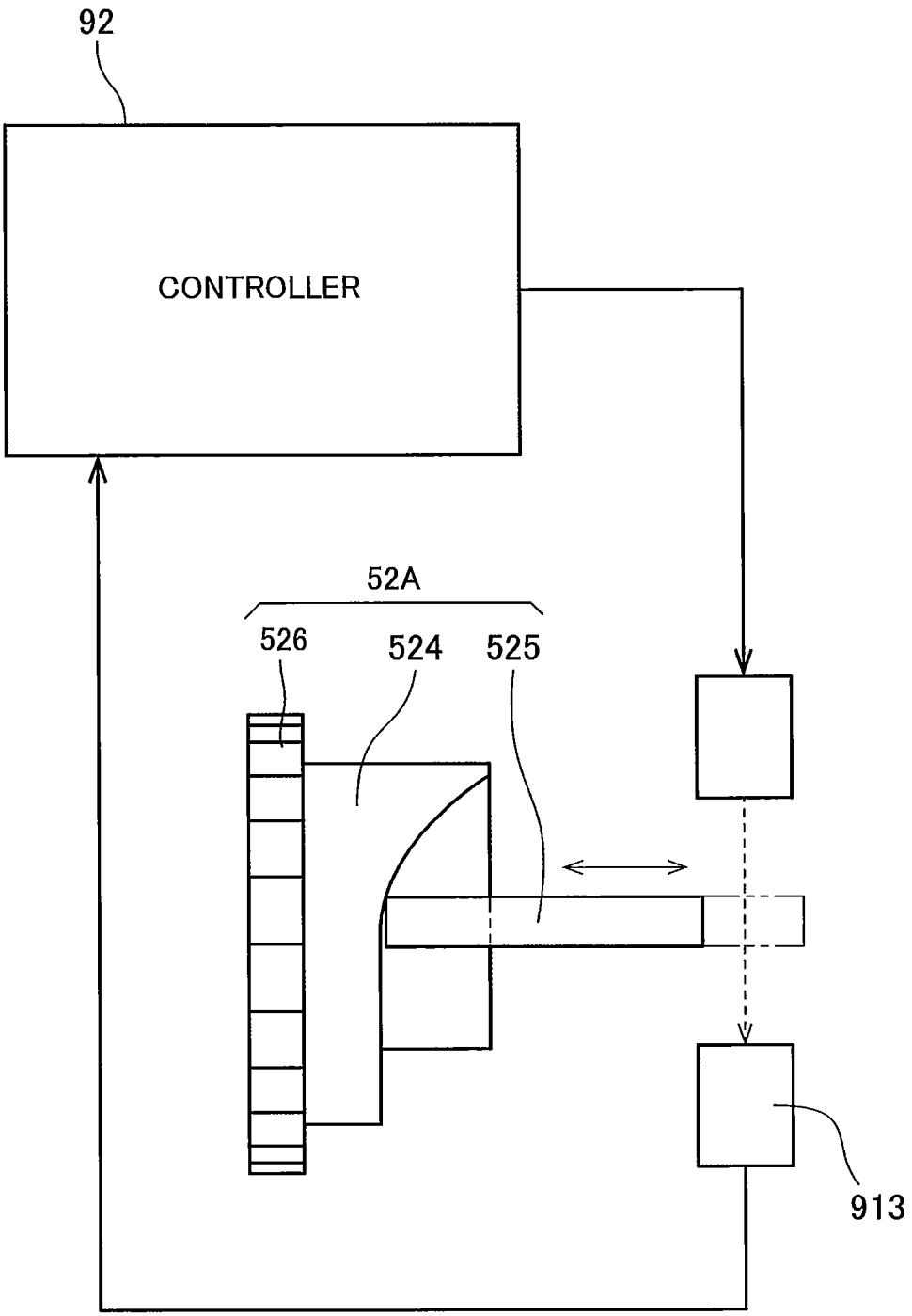
FIG. 19 is a view for description of a relationship among a detection gear, an optical sensor and a controller according to a fifth modification.

The second protrusion 522A has a circumferential length greater than that of the first protrusion 531A. Therefore, a period of the second position of the lever 912 by the second protrusion 522A is longer than a period of the second position of the lever 912 by the first protrusion 531A. In this way, the controller 92 can detect the period of the second position of the lever 912 by the first protrusion 531A and the period of the second position of the lever 912 by the second protrusion 522A different from each other by setting the circumferential lengths of the first protrusion 531A and the second protrusion 522A different from each other. Consequently, increased numbers of second yield information can be provided 8-5. Fifth Modification FIG. 19 illustrates a relationship among a detection gear 52A, a first protrusion 525, the optical sensor 913 and the controller 92. In this modification, the detection gear 52A is a member separate from the first protrusion 525. The detection gear 52A is rotatable about a rotation axis, and includes a cam portion 524 having a plurality of gear teeth 526. By the rotation of the detection gear 52A, the first protrusion 521 is moved in the axial direction in accordance with a surface of the cam portion 524. The optical sensor 913 transmits to the controller 92 the detection signal changing in accordance with the axial movement of the first protrusion 525. The controller 92 obtains the second yield information 72 related to the attached developing cartridge 1 on the basis of the detection signal obtained from the optical sensor 913.

In this way, the detection gear 52A and the first protrusion 525 may be separate members, and the first protrusion 521 may be a member movable in the axial direction.

8-6 Sixth Modification

Figure 20:
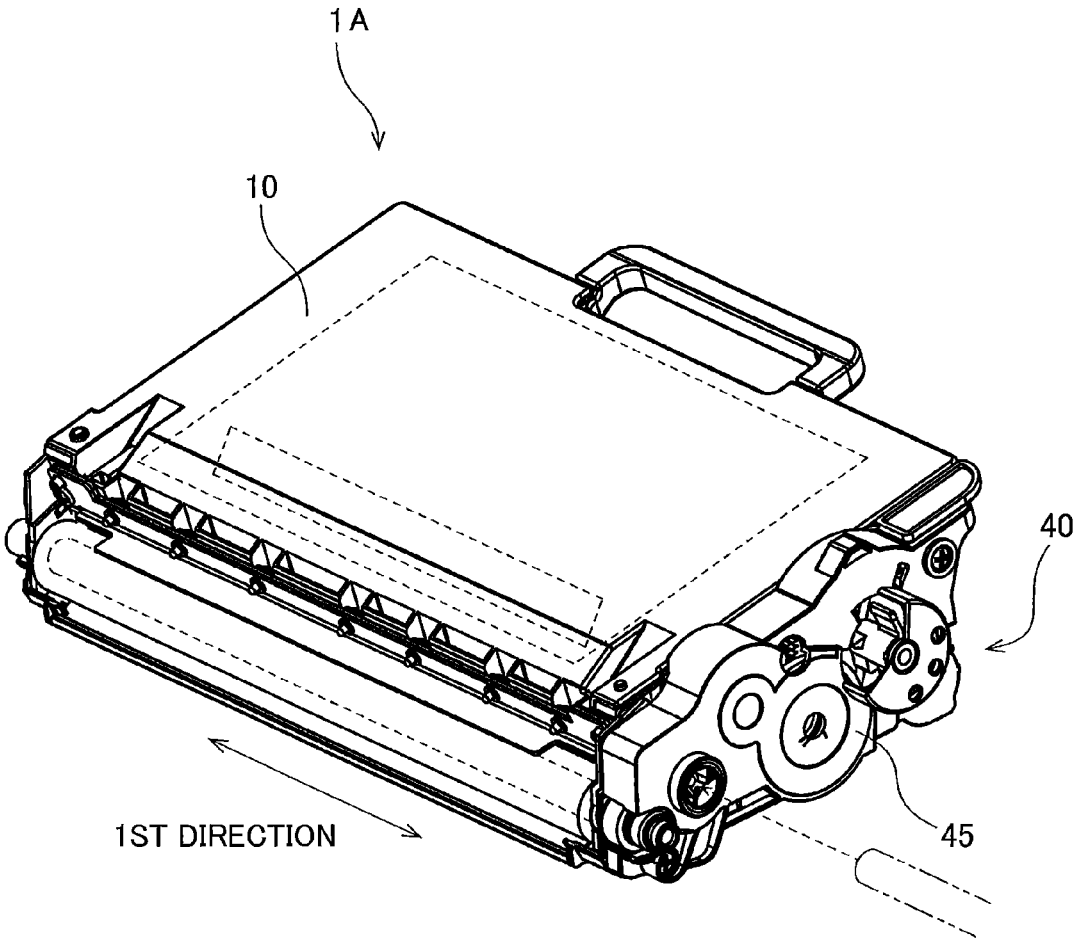
FIG. 20 is a perspective view of a developing cartridge according to a sixth modification.
Figure 21:
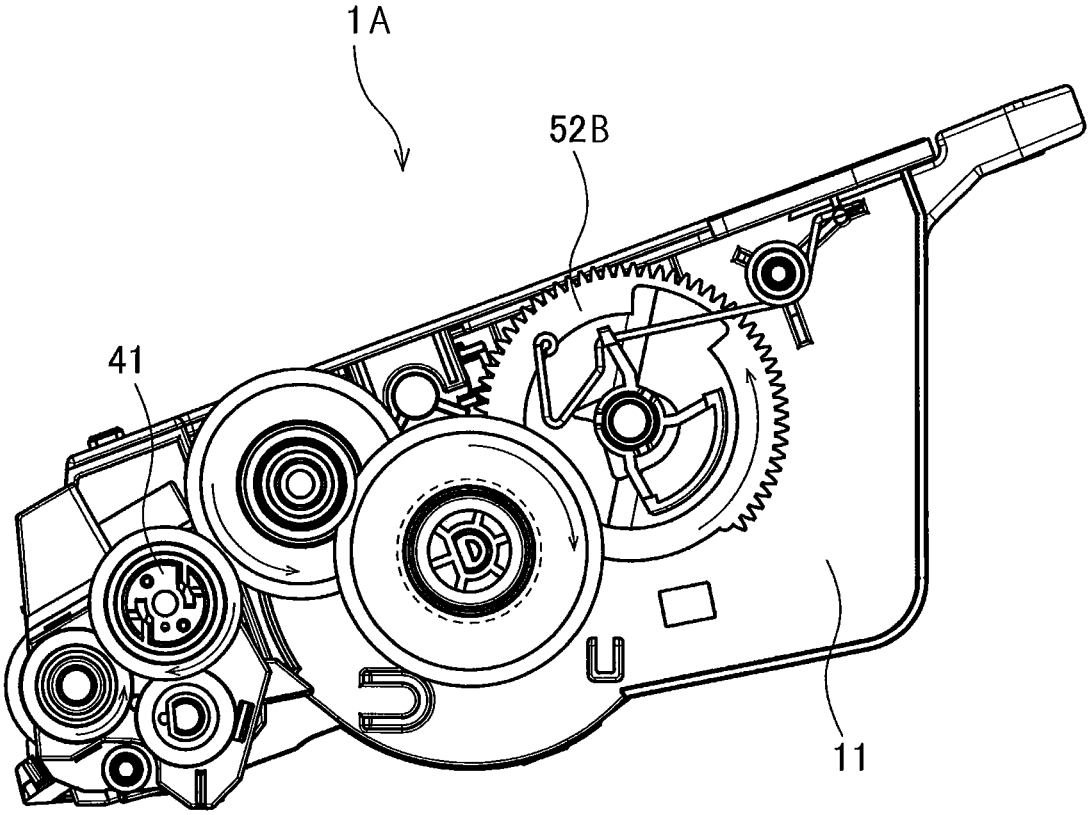
FIG. 21 is a plan view of the developing cartridge according to the sixth modification, and particularly showing a gear portion as viewed in a first direction after removal of a cover.
Figure 22:
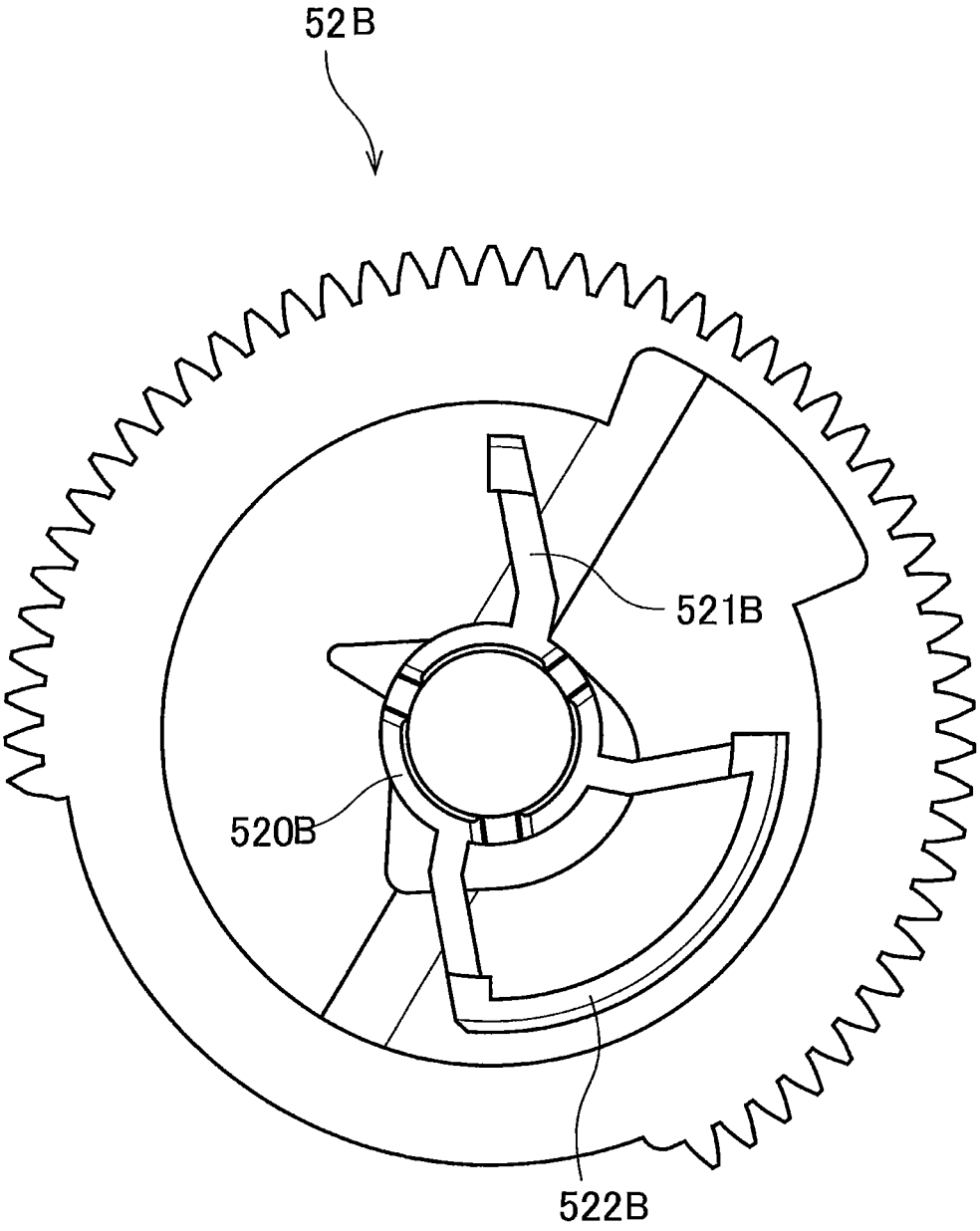
FIG. 22 is a plan view of a detection gear according to the sixth embodiment.

A developing cartridge 1A according to a sixth modification is illustrated in FIGS. 20 through 22 wherein like parts and components are designated by the same reference numerals as those shown in the above-described embodiment. According to this modification, the first gear portion 40 is provided only at the first end face 11 in the first direction. The first gear portion 40 is covered by the first cover 45. FIG. 21 is a plan view of the developing cartridge 1A, and particularly showing the gear portion 40 as viewed in the first direction after removal of the cover 45. As illustrated in FIG. 21, the coupling 41 and a plurality of gears including the detection gear 52A are positioned or aggregated at the first end face 11 of the casing 10. Incidentally, the cartridge IC may be positioned at the second end face 12 of the casing 10.

A detection gear 52B is illustrated in FIG. 22. The detection gear 52B includes a sleeve portion 520B, a first protrusion 521B, and a second protrusion 522B. The sleeve portion 520B extends from one end face of the detection gear 52B in the first direction. The first and second protrusions 521B and 522B extend radially outwardly from the sleeve portion 520B at different circumferential positions from each other. Further, the second protrusion 522B has a peripheral length greater than that of the first protrusion 521B.

8-7. Seventh Modification

Figure 23:
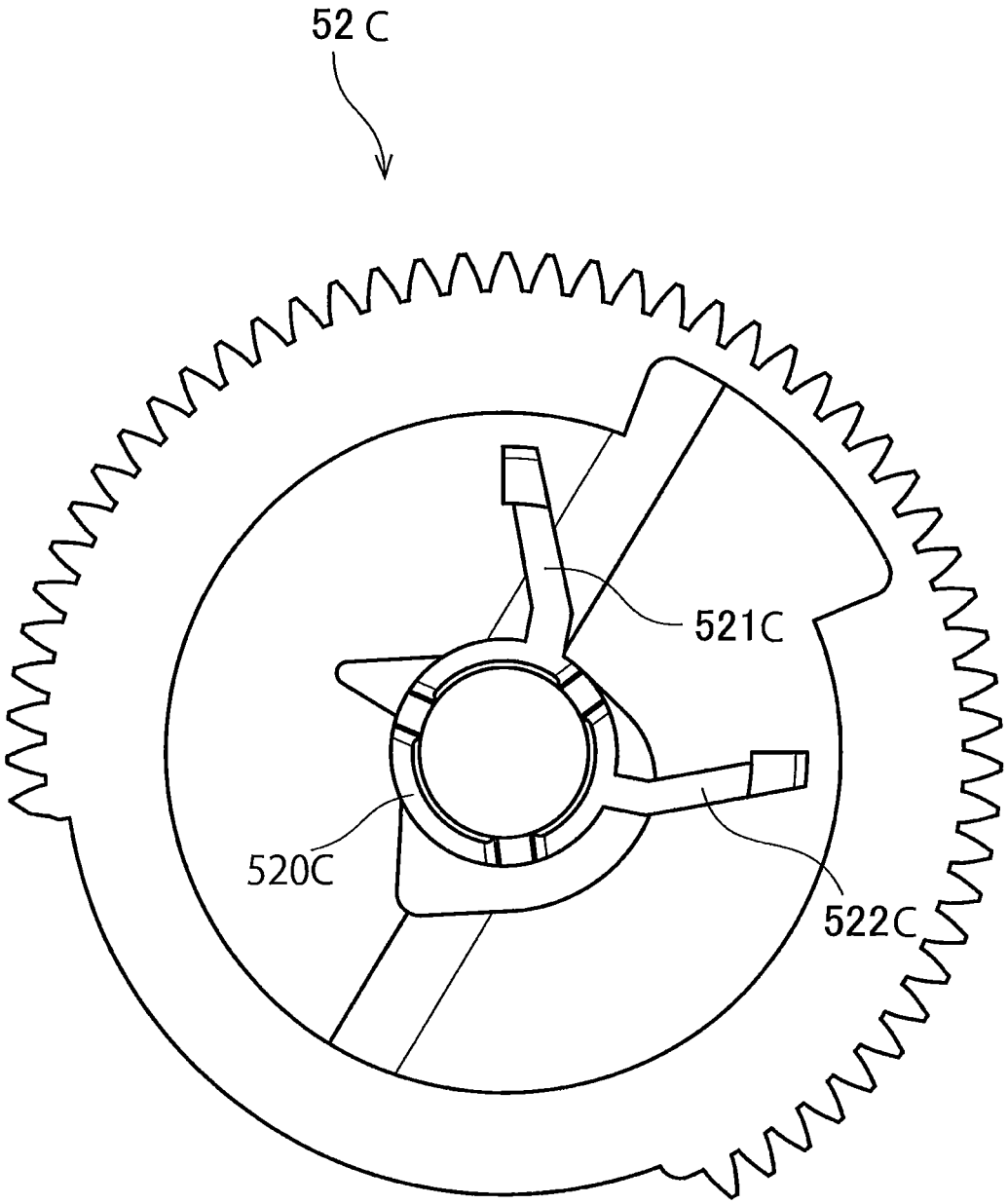
FIG. 23 is a plan view of a detection gear according to a seventh embodiment.

As illustrated in FIG. 23, in the seventh modification, a detection gear 52C includes a sleeve portion 520C, a first protrusion 521C, and a second protrusion 522C. The first and second protrusions 521C, 522C have peripheral lengths equal to each other. In other words, the peripheral length of the second protrusion 522C in the seventh modification is smaller than the peripheral length of the second protrusion 522B in the sixth modification. The second yield information can be changed by changing the peripheral length of the second protrusion.

8-8 Eighth Modification

Figure 24:
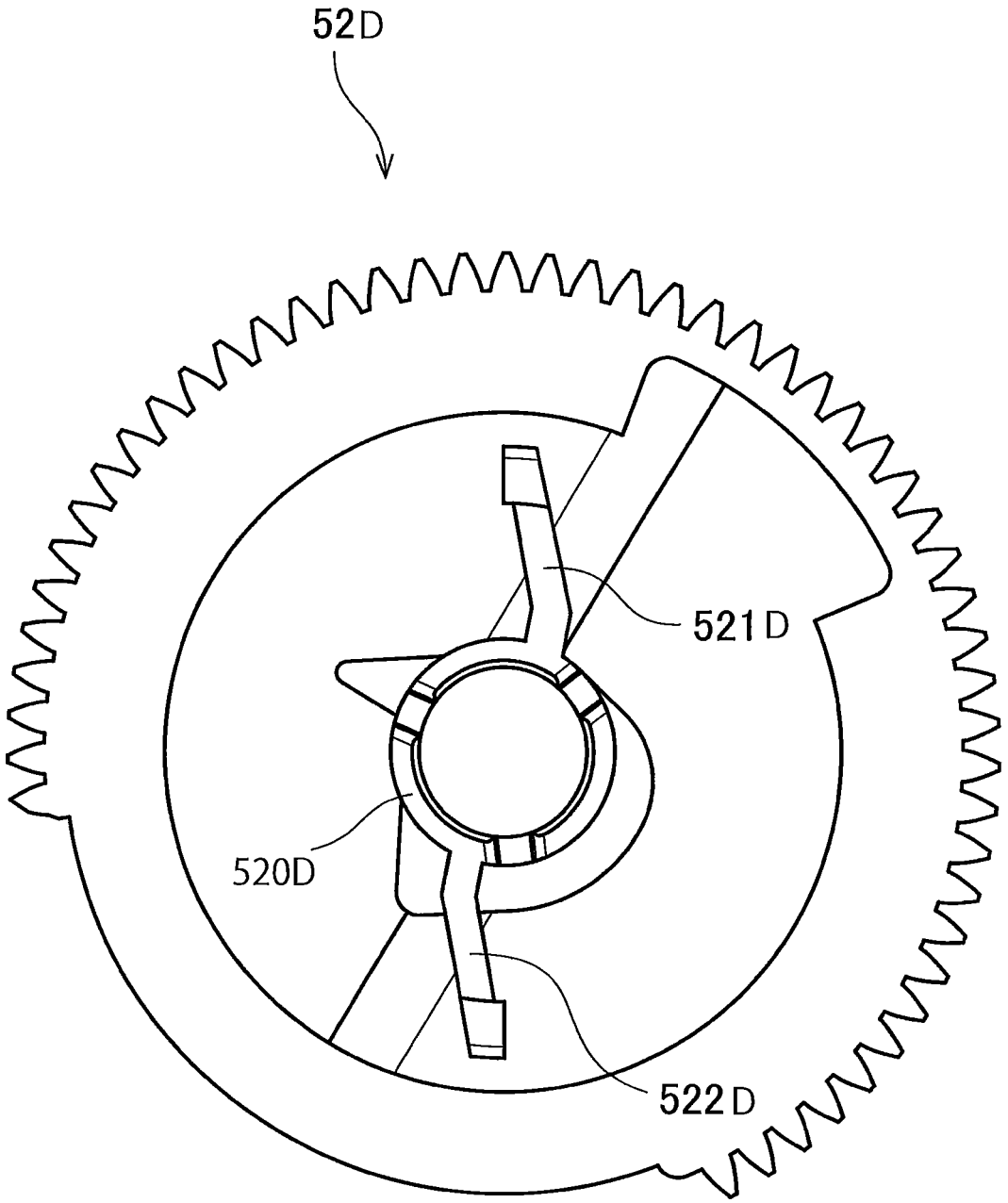
FIG. 24 is a plan view of a detection gear according to an eighth embodiment.

As illustrated in FIG. 24, in the eighth modification, a detection gear 52D includes a sleeve portion 520D, a first protrusion 521D, and a second protrusion 522D. The first and second protrusions 521D, 522D have peripheral lengths equal to each other. In other words, the peripheral length of the second protrusion 522D in the eighth modification is smaller than the peripheral length of the second protrusion 522B in the sixth modification. The second yield information may be changed by changing the peripheral length of the second protrusion.

Further, in the eighth embodiment, a distance in a circumferential direction between the first protrusion 521D and the second protrusion 522D is greater than that between the first protrusion 521C and the 522C in the seventh modification. The second yield information may be changed by changing the distance in the peripheral direction between the first and second protrusions.

8-9 Ninth Modification

Figure 25:
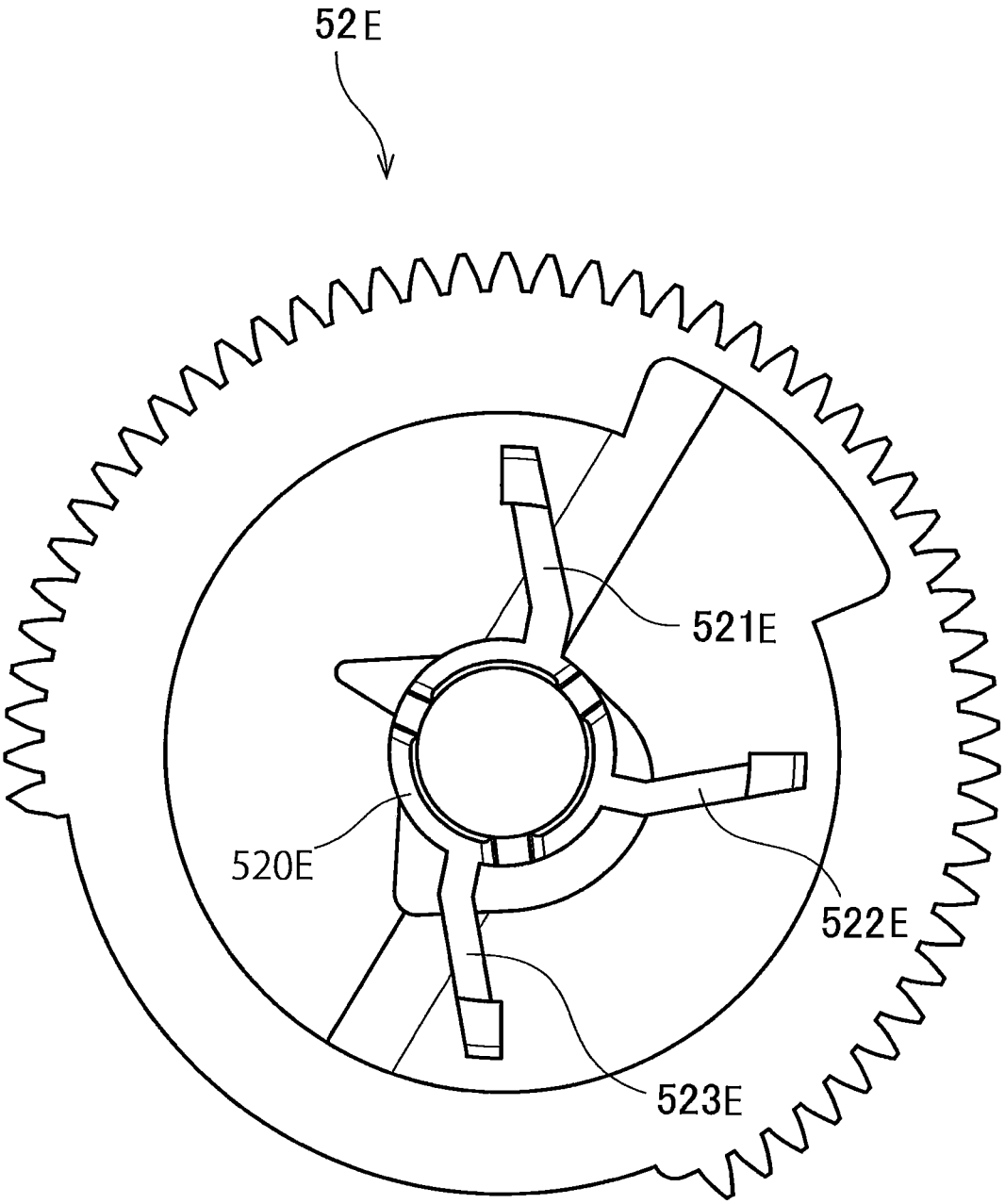
FIG. 25 is a plan view of a detection gear according to a ninth embodiment.

As illustrated in FIG. 25, in the ninth modification, a detection gear 52E includes a sleeve portion 520E, a first protrusion 521E, a second protrusion 522E, and a third protrusion 523E. The first, second, and third protrusions 521E, 522E, 523E extend radially outwardly from the sleeve portion 520E, and are positioned at circumferential positions different from each other. By providing three protrusions at the detection gear 52E, detection signals from the optical sensor can be changed in accordance with the change in circumferential distance between neighboring protrusions, and length in the circumferential direction. Accordingly, three protrusions can represent the increased numbers of the second yield information different from each other. Incidentally, not less than four protrusions may be provided at the detection gear 52E.

8-10 Other Modifications

According to the above-described embodiment, the cartridge IC having electrically contact surface is fixed to the outer surface of the holder. However, only the electrical contact surface can be fixed to the outer surface of the holder, and a memory of the cartridge IC may be provided at the developing cartridge at a position other than the outer surface.

Further, according to the above-described embodiment, the first and second gear portions are engaged with each other by meshing engagement between plurality of gear teeth of the first gear portion and the second gear portion. However, the first and second gear portion may be engaged with each other by frictional force. For example, friction members such as a rubber may be provided at positions instead of the plurality of gears.

Further, the notification such as error message is output by displaying information on the display of the image forming apparatus. However, buzzer, voice, a warning light, and printing are available for the notification instead of or in addition to displaying the information on the display.

According to the above-described embodiment, the developing cartridge 1 is attachable to the drawer unit 91. However, a developing cartridge may be attached to a drum cartridge having a single photosensitive drum. Further, a developing cartridge may be a process cartridge having a photosensitive drum. Here, the process cartridge is a single cartridge having a developing roller and a photosensitive drum. Further, instead of the developing cartridge 1, a toner cartridge is available in which a toner is accommodatable and a developing roller is not provided.

Further, in the above-described embodiment, the optical sensor 913 detects the displacement of the lever 912. However, a detection mechanism capable of detecting electrical connection can be used instead of the optical sensor 913. In this case, one of the first, second, and third protrusions 521, 522, 523 is in contact with the lever 912. When the lever 912 is positioned at the second position, electrical connection in an electrical circuit provided in the image forming apparatus is rendered ON. The detection mechanism detects ON state of the electrical circuit. On the other hand, neither one of the first, second, and third protrusions 521, 522, 523 is in contact with the lever 912, the lever 912 is positioned at the first position, and the electrical connection in the electrical circuit is rendered OFF. The detection mechanism detects the OFF state.

Further, details of the developing cartridge can be different from those illustrated in the drawings. Further, various combinations would be conceivable by picking up respective components in the embodiment and modifications and combining these components together without conflicting the teachings of the embodiment and modifications.

While the description has been made in detail with reference to specific embodiments thereof, it would be apparent to those skilled in the art that various changes and modifications may be made therein without departing from the spirit and scope of the above described embodiments.

What is claimed is:

1. A cartridge configured to accommodate a developing agent, the cartridge comprising:

a detection gear rotatable about a first axis extending in a predetermined direction;

a first protrusion movable with rotation of the detection gear, wherein the at least one of the amount of the developing agent in the cartridge and the number of printable sheets by the developing agent in the cartridge is defined by motion of the first protrusion; and a memory including a first storage region storing a first yield information representing the at least one of the amount of the developing agent in the cartridge and the number of printable sheets by the developing agent in the cartridge, wherein the at least one of the amount of the developing agent and the number of printable sheets by the developing agent in the cartridge is confirmable based on both of the first yield information and motion of the first protrusion in response to rotation of the detection gear.

2. The cartridge according to claim 1, wherein the first protrusion extends in the predetermined direction.

3. The cartridge according to claim 1, wherein the detection gear includes the first protrusion.

4. The cartridge according to claim 1, wherein the detection gear further includes a second protrusion movable with the rotation of the detection gear, the at least one of the amount of the developing agent and the number of printable sheets by the developing agent in the cartridge being confirmable based on both of the first yield information and the motions of the first protrusion and the second protrusion in response to the rotation of the detection gear.

5. The cartridge according to claim 4, wherein the second protrusion extends in the predetermined direction.

6. The cartridge according to claim 4, wherein the detection gear includes the second protrusion.

7. The cartridge according to claim 4, wherein the first protrusion includes a first outer end portion positioned at an outer edge of the first protrusion in a radial direction of the detection gear; and wherein the second protrusion includes a second outer end portion positioned at the outer edge of the second protrusion in the radial direction, the second outer end portion and the first outer end portion being separated from each other.

8. The cartridge according to claim 4, wherein the first protrusion extends in a circumferential direction of the detection gear, wherein the second protrusion extends in the circumference direction, wherein the first protrusion having a first length in the circumference direction and the second protrusion having a second length in the circumference direction different from the first length; and wherein the at least one of the amount of the developing agent and the number of printable sheets by the developing agent in the cartridge is confirmable based on both of the first length and the second length and the first yield information.

9. The cartridge according to claim 4, wherein the cartridge is attachable to an image forming apparatus having a portion;

wherein the first protrusion is in contact with the portion in a state where the cartridge is attached to the image forming apparatus and the detection gear rotates; and wherein the second protrusion is in contact with the portion in a state where the detection gear rotates and the first protrusion is separated from the portion.

10. The cartridge according to claim 1, wherein the cartridge is attachable to an image forming apparatus having a portion; and wherein the first protrusion is in contact with the portion in a state where the cartridge is attached to the image forming apparatus and the detection gear rotates.

11. The cartridge according to claim 1, wherein the memory further has a second storage region configured to store yield confirmation information indicating whether the first yield information and second yield information representing the at least one of the amount of the developing agent in the cartridge and the number of printable sheets by the developing agent in the cartridge which is determinable by the motion of the first protrusion are inconsistent with each other.

12. The cartridge according to claim 1, further comprising a coupling configured to receive a drive force; and wherein the detection gear is rotatable according to the drive force.

13. The cartridge according to claim 12, further comprising:

a developing roller rotatable about a roller shaft having a second axis extending in the predetermined direction; and a developing roller gear mounted to the developing roller shaft and rotatable together with the developing roller; and wherein the coupling is rotatable about a third axis extending in the predetermined direction, and includes a coupling gear rotatable together with the coupling and engaging with the developing roller gear.

14. The cartridge according to claim 13, further comprising a supply roller rotatable about a fourth axis extending in the predetermined direction and configured to supply the developing agent to the developing roller.

15. The cartridge according to claim 1, further comprising an IC (Integrated Circuit) chip having the memory.

16. An image forming apparatus comprising:

a cartridge configured to accommodate a developing agent, the cartridge including:

a detection gear rotatable about a first axis extending in a predetermined direction;

a first protrusion movable with rotation of the detection gear, wherein the at least one of the amount of the developing agent in the cartridge and the number of printable sheets by the developing agent in the cartridge is defined by motion of the first protrusion; and a first memory including a first storage region storing a first yield information representing the at least one of the amount of the developing agent in the cartridge and the number of printable sheets by the developing agent in the cartridge;

a frame configured to hold the cartridge;

a sensor configured to detect movement of the first protrusion to generate second yield information; and a controller configured to confirm the at least one of the amount of the developing agent in the cartridge and the number of printable sheets by the developing agent based on both of the first yield information obtained from the memory and the second yield information generated by the sensor.

17. The image forming apparatus according to claim 16, wherein the controller is configured to determine whether the first yield information and the second yield information are coincident with each other; and wherein the controller is configured to confirm, based on a result of the determination, the at least one of the amount of the developing agent in the cartridge and the number of printable sheets by the developing agent in the cartridge.

18. The image forming apparatus according to claim 17, wherein the controller is configured to further perform a print processing based on the at least one of the amount of the developing agent and the number of printable sheets represented by one of the first yield information and the second yield information, when the controller determines that the first information and the second information are coincident with each other.

19. The image forming apparatus according to claim 17, wherein, when the controller determines that the first information and the second information are inconsistent with each other, the controller is configured to perform a print processing based on one of:

smaller one of the amount of the developing agent represented by the first yield information and the amount of the developing agent represented by the second yield information; and smaller one of the number of printable sheets represented by the first yield information and the number of printable sheets represented by the second yield information.

20. The image forming apparatus according to claim 17, further comprising a second memory configured to store third yield information; and wherein the controller is configured to perform a print processing based on the third yield information, when the controller determines that the first information and the second information are inconsistent with each other.

21. The image forming apparatus according to claim 17, wherein the first memory further has a second storage region; and wherein the controller is configured to write, in the second storage region, yield confirmation information including a result of the determination representing whether the first yield information and the second yield information are inconsistent with each other.

22. The image forming apparatus according to claim 17, wherein the controller is configured to output a notification when the controller determines that the first information and the second information are inconsistent with each other.

23. The image forming apparatus according to claim 22, further comprising a display configured to indicate the notification.

24. The image forming apparatus according to claim 17, further comprising a non-volatile memory configured to store halt information representing that power supply to the image forming apparatus was interrupted while the sensor was detecting the movement of the first protrusion; and wherein the controller is configured such that in a case where the halt information is stored in the non-volatile memory, the controller performs a printing processing to print based on the at least one of the amount of the developing agent and the number of printable sheets represented by the first yield information.

25. The image forming apparatus according to claim 16, wherein the cartridge has an IC (Integrated Circuit) chip having the memory.

* * * * *